US007182624B1

(12) United States Patent
Miller

(10) Patent No.: US 7,182,624 B1
(45) Date of Patent: Feb. 27, 2007

(54) PLUG RETENTION APPARATUS

(75) Inventor: Thomas J. Miller, Diamond Bar, CA (US)

(73) Assignee: TMC Enterprises, Diamond Bar, CA (US)

( * ) Notice: Subject to any disclaimer, the term of this patent is extended or adjusted under 35 U.S.C. 154(b) by 0 days.

(21) Appl. No.: 11/226,846

(22) Filed: Sep. 13, 2005

Related U.S. Application Data

(63) Continuation-in-part of application No. 11/188,206, filed on Jul. 21, 2005, which is a continuation-in-part of application No. 10/777,401, filed on Feb. 12, 2004, now Pat. No. 6,957,977.

(60) Provisional application No. 60/519,762, filed on Nov. 13, 2003, provisional application No. 60/661,053, filed on Mar. 10, 2005.

(51) Int. Cl.
*H01R 13/62* (2006.01)

(52) U.S. Cl. ..... 439/369

(58) Field of Classification Search ..... 439/369–373
See application file for complete search history.

(56) References Cited

U.S. PATENT DOCUMENTS 1,665,095 A 4/1928 Henry
2,753,536 A 7/1956 Tjader
3,344,393 A * 9/1967 Hendee ..... 439/369
3,609,638 A * 9/1971 Darrey ..... 439/369
4,204,738 A 5/1980 Tillotson
4,875,874 A 10/1989 Windsor, Jr.
5,211,573 A 5/1993 Cross
5,393,243 A 2/1995 Carmo
5,584,720 A 12/1996 Elswick
5,785,547 A 7/1998 Cross et al.
5,834,690 A * 11/1998 Bastiaansen ..... 174/564
6,056,580 A 5/2000 Cross et al.
6,080,004 A 6/2000 Kovacik et al.

* cited by examiner

*Primary Examiner*—Neil Abrams
(74) *Attorney, Agent, or Firm*—Knobbe Martens Olson & Bear LLP

(57) ABSTRACT

A plug retention apparatus for use in securing two plug members together to prevent undesired disengagement. The plug retention apparatus is affixed to a first plug member using a retention ring which provides a means for adjustable positioning via a threaded coupling to facilitate securing a second plug member to the first plug member. A plug clamp may be rotatably positioned about the second plug member retaining the plug members in a desired position. The plug retention apparatus may include a sleeve removably disposed about the cord of the first plug. The clamp used for retaining the second plug may include a cord support, a latch to secure the cord on the support and a locking mechanism to selectively retain the latch in a closed position.

33 Claims, 21 Drawing Sheets

PLUG RETENTION APPARATUS

RELATED APPLICATIONS

This application is a continuation-in-part of U.S. application Ser. No. 11/188,206 filed Jul. 21, 2005, which is a continuation-in-part of U.S. patent application Ser. No. 10/777,401 filed Feb. 12, 2004, now U.S. Pat. No. 6,957,977, which claims the benefit of U.S. Provisional Application 60/519,762, filed Nov. 13, 2003, which is hereby incorporated by reference in its entirety herein and should be considered a part of this specification. This application also claims priority to U.S. Provisional Application No. 60/661,053, filed Mar. 10, 2005, which is hereby incorporated by reference in its entirety and should be considered a part of this specification.

BACKGROUND

1. Field of the Invention

The present teachings relate to electrical cords and, in particular, to a device and methods for maintaining engagement between electrical plug connections.

2. Description of the Related Art

Electrical devices such as power tools, household appliances, and other consumer electronics often possess a cord having a plug to be engaged with a receiving socket such as that found on an extension cord or the like. The cords of these devices are subject to snagging and may be easily disengaged, interrupting the electrical connection and posing a potential safety hazard if the plug becomes partially disengaged thereby exposing the contacts.

To address this issue, it has been suggested to position a retaining structure over the connected plugs or sockets to prevent disengagement of the plugs. Unfortunately, typical retaining structures are not adaptable to fit different sizes of electrical plugs. For example, U.S. Pat. No. 4,204,738 to Tillotson illustrates a typical electrical cord securing device that has a securing member attached to the male end of an electrical cord. The securing member is adapted to attach to the mating electrical cord. However, the securing member is not adjustable. Hence, the cord that is to be attached and secured with this device must be sized to the securing device which limits the use of the securing device to just a single cord.

A further difficulty with plug securing devices is that the portion that actually attaches to the electrical cord can become dislodged as a result of force exerted on the cord. It will be appreciated that in many different circumstances, the forces exerted on the cords can be quite large as people are pulling or otherwise flexing the cords. Hence, there is a continuing need to be able ensure that the plug retention apparatus is less likely to become dislodged from the cord or plug.

Yet another difficulty with existing electrical plug retaining devices is that the retaining devices are generally set up for cords having a single plug. In many industrial and construction applications, multiple electrical devices are attached to electrical cords having multiple plug assemblies. Construction applications in particular are very susceptible to cords being dislodged due to the rough use of tools that often occurs in construction environments.

Based on the foregoing, there is an ongoing need for improved securing devices that ensure that electrical cords remain plugged together. To this end, there is a need for securing devices that are less likely to be dislodged from the plugs or cords and are also better able to accommodate multiple plugs and cords.

SUMMARY

In various embodiments, the present teachings describe a plug retention device used in conjunction with a socketed electrical cord wherein the electrical cord comprises a first plug member that is retained in contact with a second plug member by way of a securing clamp. At least one plug member is threaded to accommodate a retention ring that may be adjustably positioned about the threaded plug member. A plug clamp is attached to the retention ring in such a manner so as to allow pivotal positioning. The plug clamp further comprises a cord guide which secures the cord and allows it to be passed through a portion of the plug clamp in an unobstructed manner. In various embodiments, the first plug member comprises a male plug member having at least one conductive element extending therefrom and the second plug member comprises a female plug member having a receiving socket into which the at least one conductive element is desirably secured to establish an electrical connection between the two plug members. The plug retention device secures the connection between plug members via the plug clamp which is positioned about one of the plug members and retained in a first position preventing axial movement of the plug members by the retention ring secured to the opposing plug member.

In one embodiment, the aforementioned needs may be satisfied by an electrical cord retention apparatus for maintaining electrical connection between a first and a second electrical cord. The retention apparatus comprises a sleeve removably disposed about the first electrical cord and a retainer assembly that couples to the sleeve, the retainer assembly having a support surface that receives a second electrical cord. The retention apparatus also comprises a securing member movably attached to the retainer assembly, wherein the securing member is movable between a first orientation, thereby allowing the second electrical cord to be positioned adjacent the support surface, and a second orientation, wherein the securing member secures the second electrical cord adjacent the support surface.

In another embodiment, an electrical cord retention assembly for maintaining electrical connection between a first plug member of a first electrical cord and a second plug member of a second electrical cord, the first and second electrical cords being suitable for conducting electricity, is provided. The retention assembly comprises a first member removably disposed about the first electrical cord, a second member coupled to the first member, and a retainer assembly coupled to the second member and including a support surface that receives the second electrical cord. The retentions assembly also comprises a latch movably coupled to the retainer assembly, wherein the latch being movable between an open position to allow the second cord member to be positioned on the support surface and a closed position wherein the latch secures the second electrical cord adjacent the support surface so that the second electrical cord can couple to the retainer assembly, and so that the first and second electrical cords couple to each other between the first member and the retainer assembly, wherein the retainer assembly and the first member are movable relative to each other to decrease a distance therebetween so as to inhibit the disconnection of the first and second electrical cords.

In another embodiment, an electrical cord retention apparatus for maintaining an electrical connection between a first electrical cord and a second electrical cord is provided. The apparatus comprises a first member removably disposed about a first electrical cord so that the first member is adapted to allow the first electrical cord to be retrofitted with the retention apparatus, and a second member coupled to the first member, the first and second member adapted to move relative to each other. A retainer assembly couples to the second member, the retainer assembly having a support surface that receives a second electrical cord so that the retainer assembly can be coupled to the second electrical cord, and so that the first and second electrical cords couple to each other between the first member and the retainer assembly, wherein the retainer assembly and the first member are moveable relative to each other to decrease a distance therebetween so as to inhibit the disconnection of the first and second electrical cords.

These and other aspects, advantages, and novel features of the present teachings will become apparent upon reading the following detailed description and upon reference to the accompanying drawings.

DETAILED DESCRIPTION OF CERTAIN EMBODIMENTS

In the following detailed description, terms of orientation such as "front," "rear," "top" and "bottom" are used to simplify the description of the context of the illustrated embodiments. Likewise, terms of sequence, such as "first," and "second" are used to simplify the description of the illustrated embodiments. Because other orientations and sequences are possible, however, the present invention should not be limited to the illustrated orientations. Those skilled in the art will appreciate that other orientations of the various embodiments disclosed herein are possible.

Reference will now be made to the drawings wherein like numerals refer to like parts throughout. An apparatus for maintaining engagement between electrical plug connections will be described in greater detail herein below with reference to the drawings.

Figure 1:
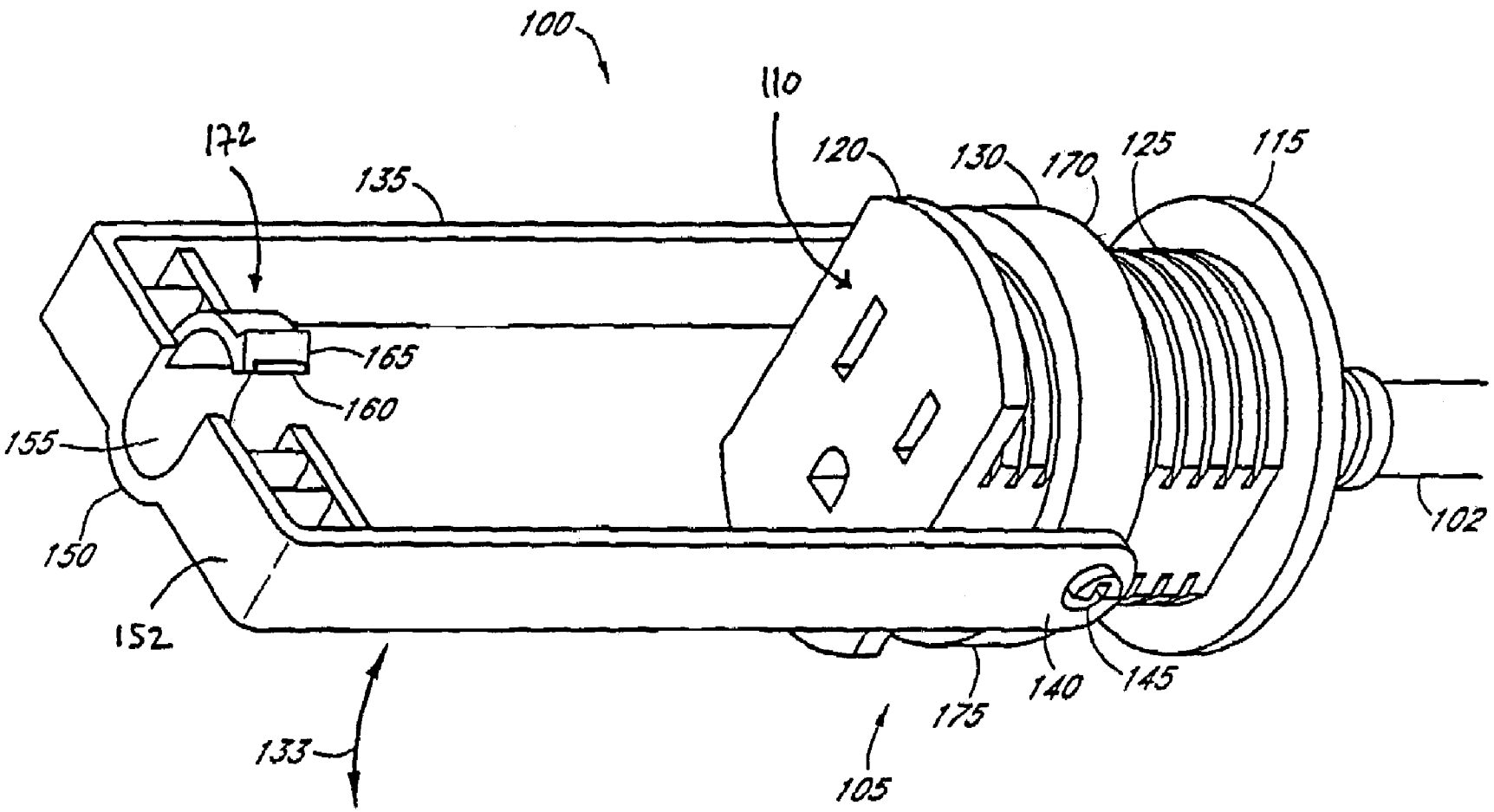
FIGS. 1–3 illustrate one embodiment of the plug retention apparatus.

FIG. 1 illustrates one embodiment of a plug retention apparatus 100. The plug retention apparatus 100 comprises a first plug member 105 attached to one end of an electrical cord 102 having a receiving socket 110 adapted to receive conductive elements of a second plug member 200 (FIGS. 4–7). In general, the electrical cord 102 may comprise any cord member suitable for supplying electrical power to a household or commercial device, such as an appliance. In various embodiments, the first plug member 105 comprises a female plug that is adapted to accommodate connection to conventional electrical cords such as those found on household electronics, power tools, and the like. It should be appreciated, however, that the first plug member 105 may also comprise a male plug that is adapted to accommodate connection to conventional electrical cords.

The first plug member 105 further comprises a base portion 115 and a head portion 120 having a threaded section 125 disposed between the base portion 115 and the head portion 120. In one aspect, the threaded section 125 comprises a threaded shaft interposed between the base and head portions 115, 120 of the first plug member 105. Also, the threaded section or shaft 125 is an integral part of the plug member 105. In addition, a retention ring or collar 130 is secured to the first plug member 105 about the threaded section 125, wherein the retention ring 130 is adapted to moveably engage the first plug member 105 about the threaded section 125. In one aspect, the retention ring 130 comprises a threaded interior surface that is adapted to engage the threaded section 125 of the first plug member 105. Advantageously, this allows the retention ring 130 to move along the threaded section 125 between the base and head portions 115, 120 of the first plug member 105.

Additionally, in various embodiments, the retention ring 130 may be positioned about the first plug member 105 by rotational motion in which the retention ring 130 is adapted to engage the threaded section 125 to move up or down as desired. In one aspect, axial movement of the retention ring 130 about the first plug member 105 is constrained between the base portion 115 and the head portion 120 such that the retention ring 130 is constrained to a range of positions. As will be described in greater detail herein below, movement and positioning of the retention ring 130 in the aforementioned manner desirably provides a means by which to adjust the retention ring 130 to accommodate joining of the second plug member 200 with the first plug member 105 to be thereafter secured in position preventing undesirable disengagement.

Figure 4:
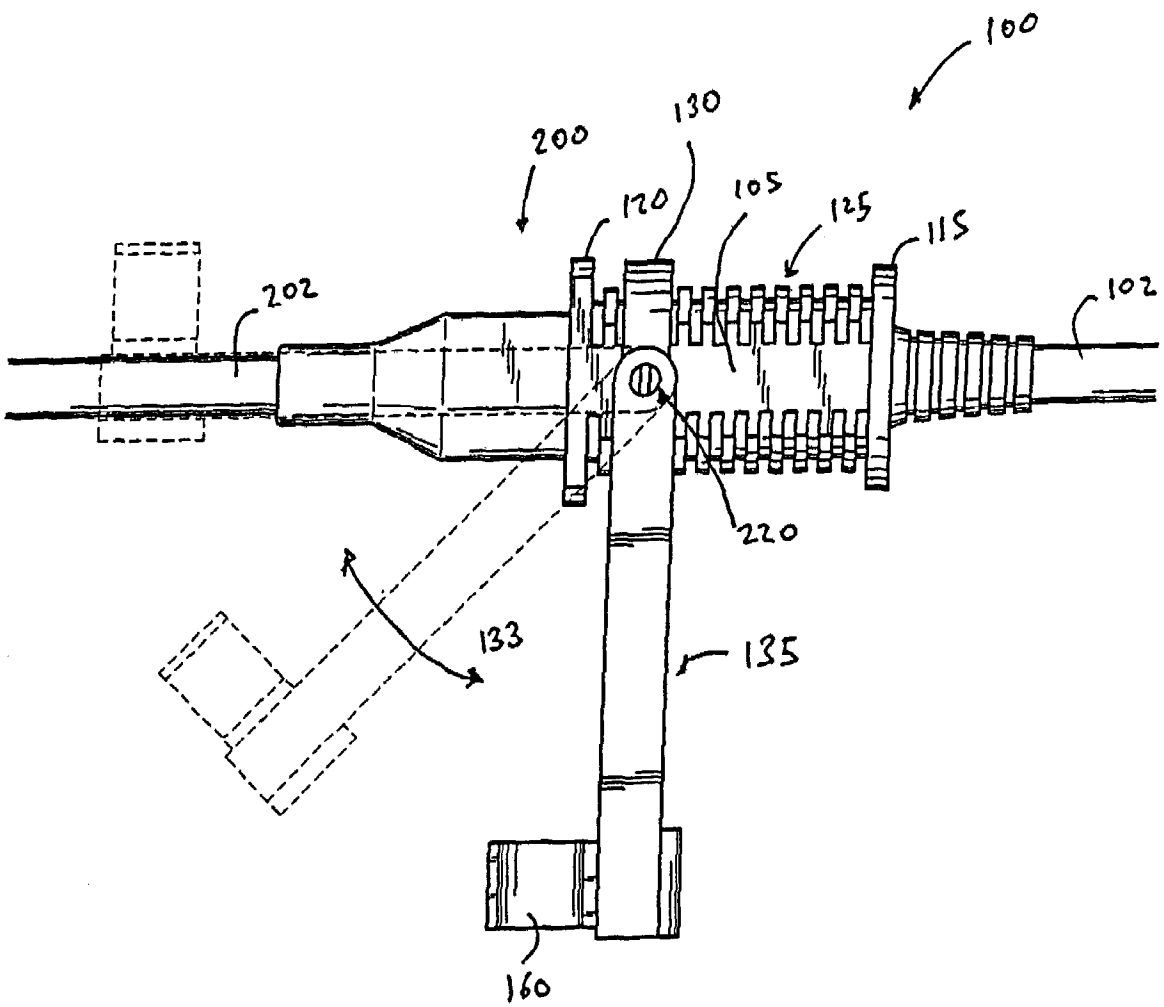
FIG. 4 illustrates the pivotal movement of a member of the plug retention apparatus.

A plug clamp 135 is further secured to the retention ring 130, wherein the plug clamp 135 comprises a U-shaped member having first and second pivot ends 140. Each pivot end 140 may comprise a through-going opening adapted to receive a grommet portion 145 of the retention ring 130 that secures the plug clamp 135 to the retention ring 130. When attached in this manner, the plug clamp 135 may be angularly pivoted 133 from the first plug member 105 to facilitate joining with the second plug member 200 as illustrated in FIG. 4.

Additionally, the plug clamp 135 further comprises a cord guide 150 positioned along a cross member portion 152 of the plug clamp 135. The cord guide 150 comprises an opening 155 in the plug clamp 135 which is adapted to receive a portion of an electrical cord attached to the second plug member 200. In one aspect, the cord guide 150 allows passage of the electrical cord attached to the second plug member 200 through a portion of the plug clamp 135 in a substantially unobstructed manner while at the same time retaining the electrical cord 102 in a desired position.

Figure 5:
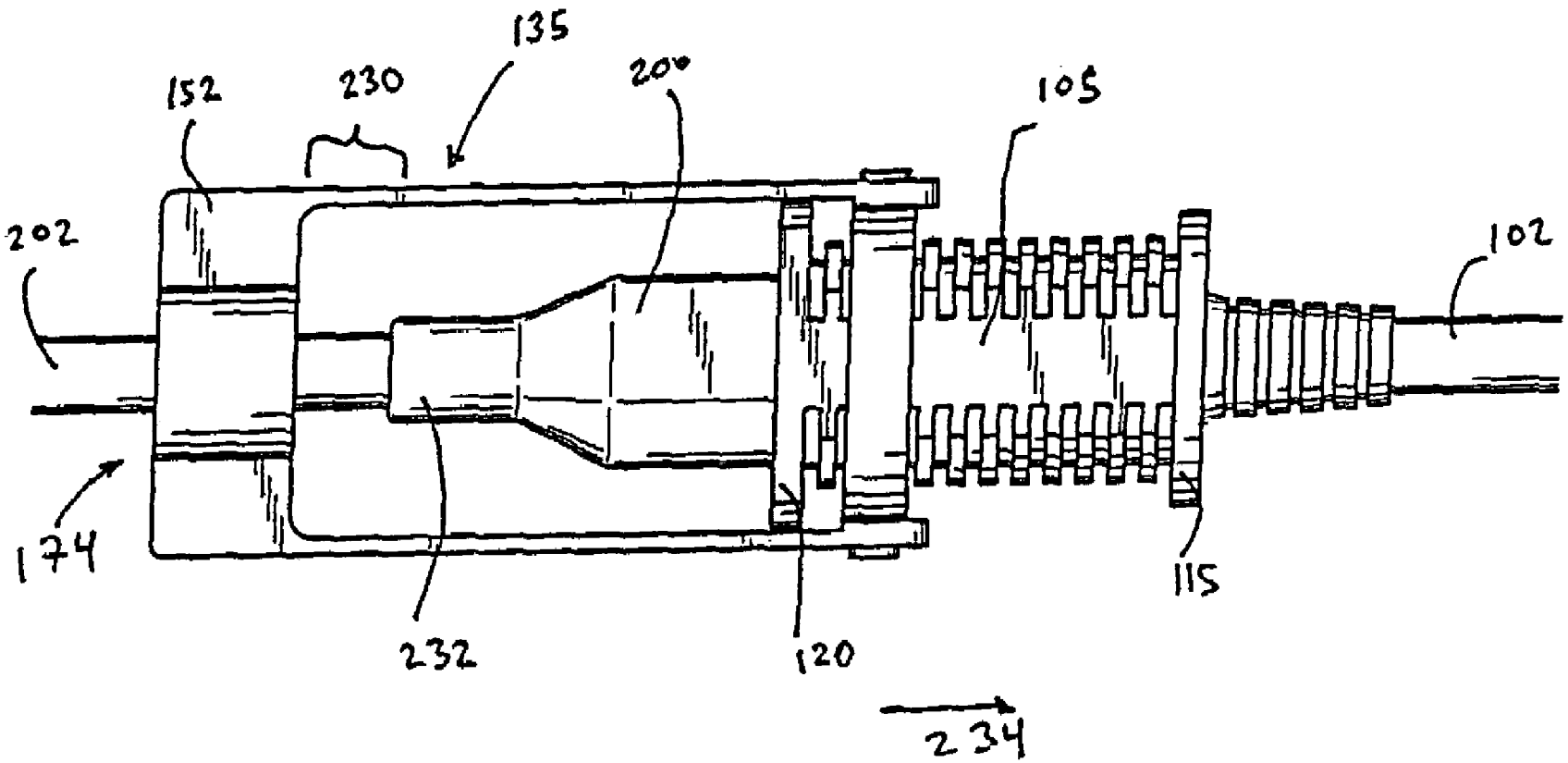
FIGS. 5–6 illustrate one embodiment of securing a plurality of cord members with the plug retention apparatus.
Figure 6:
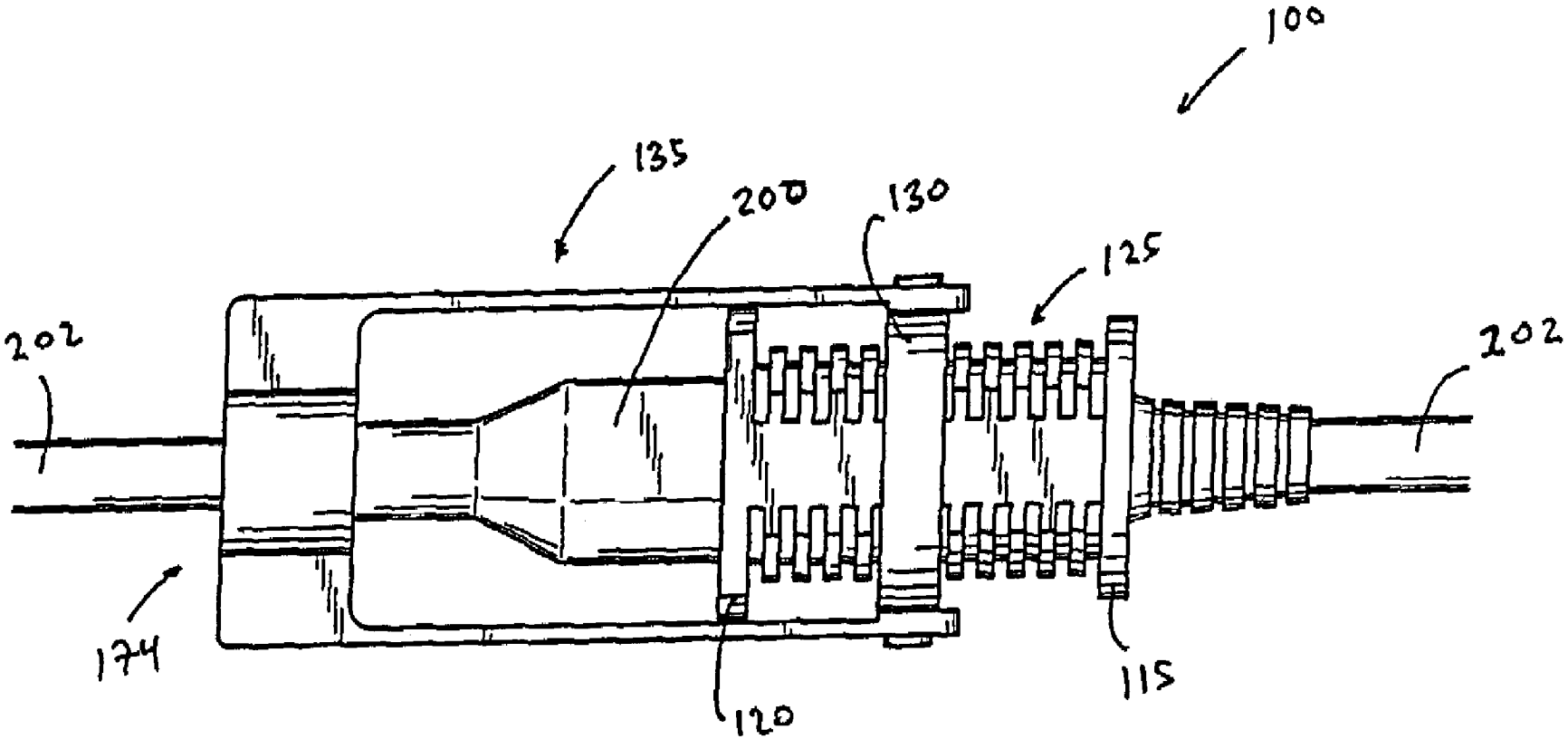

Moreover, in one aspect, the cord guide 150 comprises a latching member 160 that may reside in a first open position 172 as illustrated in FIG. 1, wherein an opening is formed to allow the electrical cord 102 attached to the second plug member 200 to be captured within the opening 155 of the cord guide 150. The latching member 160 may be further retained in a second closed position 174, as illustrated in FIGS. 5–6, so as to be secured to a portion of the cord guide 150 by way of a latch 165. When so positioned as described for example, the latching member 160 may be adapted to capture a portion of the electrical cord 102 passed through the cord guide 150 allowing the electrical cord 102 to be angularly positioned above the first plug member 105 as the plug clamp 135 is moved into position about the second plug member 200 (FIG. 4). Preferably, the latching member 160 is movable into the first open position 172 and the second closed position 174 via a hinge 254 which attaches the latching member 160 to the cross member portion 152 of the plug clamp 135.

In various embodiments, the ring member 130 may comprise detachable sections 170, 175 which allow for placement and removal from the threaded section 125. The detachable sections 170, 175 may further be secured via the grommets 145 which join the detachable sections 170 upon fastening of the plug clamp 135. Taken together the construction of the plug retention apparatus 100 is such that it may be designed as a part integrated into the first plug member 105 or alternatively may be adapted as a removable component. In one aspect, as illustrated in FIG. 4, the plug clamp 135 pivots about the grommets 145 so as to capture a portion of the electrical cord 102 within the opening 155 of the cord guide 150.

Figure 2:
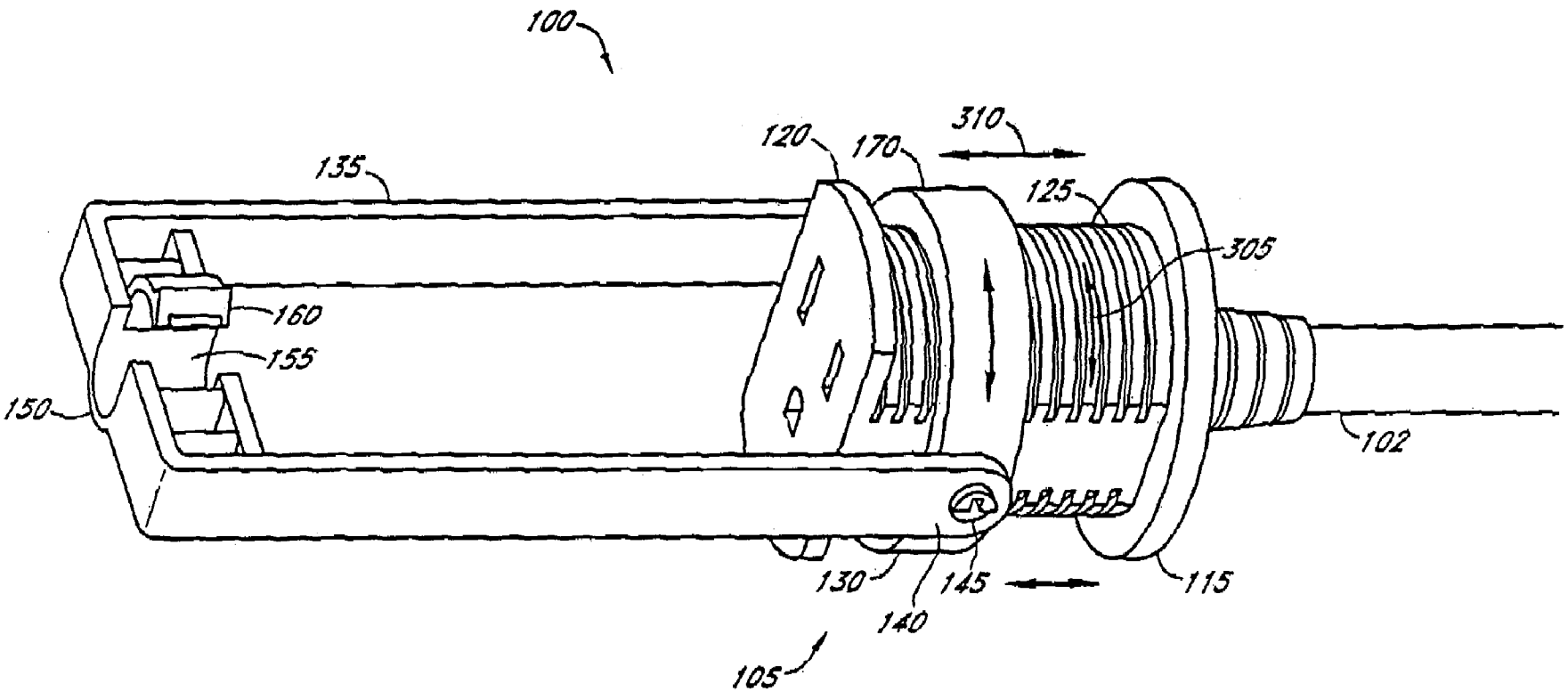
Figure 3:
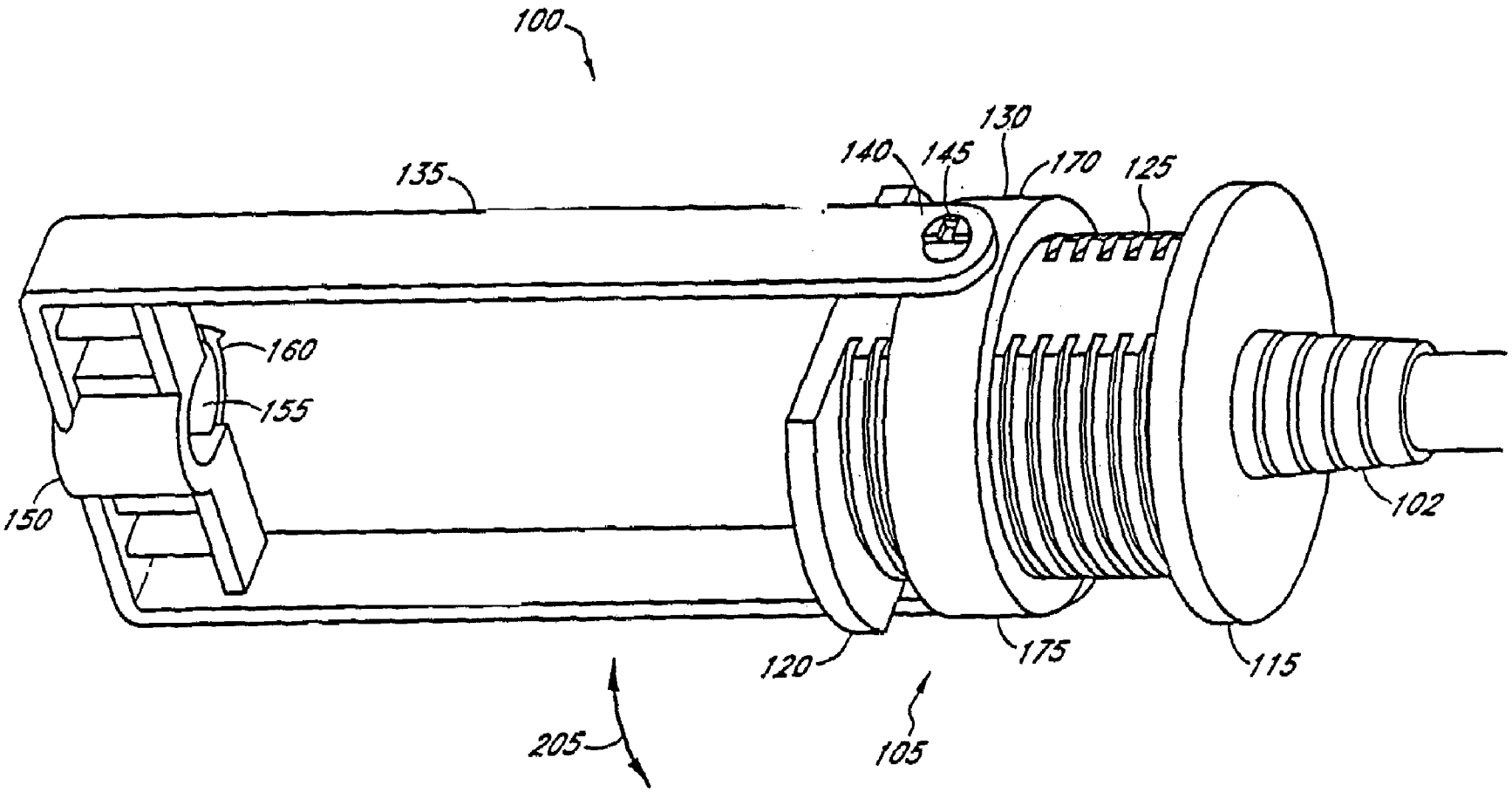

FIG. 2 illustrates a rear perspective view of the plug retention apparatus 100. FIG. 3 illustrates a side perspective view of the plug retention apparatus 100 wherein positioning of the retention ring is used to secure the first and second plug members 105, 200. In one aspect, as illustrated in FIGS. 2–3, the general construction of the plug clamp 135 and cord guide 150 from this perspective further illustrates how the electrical cord 102 may be retained within the opening 155 of the cord guide 150. In addition, the pivot arrows 205, 210 indicate how the plug clamp 135 may be positioned to accommodate joining of the second plug member 200 with the first plug member 105. Once the plug members 105, 200 have been engaged in a manner as illustrated in FIGS. 4–7, the plug clamp 135 may be repositioned over the second plug member 200, wherein the cord guide 150 captures the electrical cord 202 associated with the second plug member 200.

Figure 7:
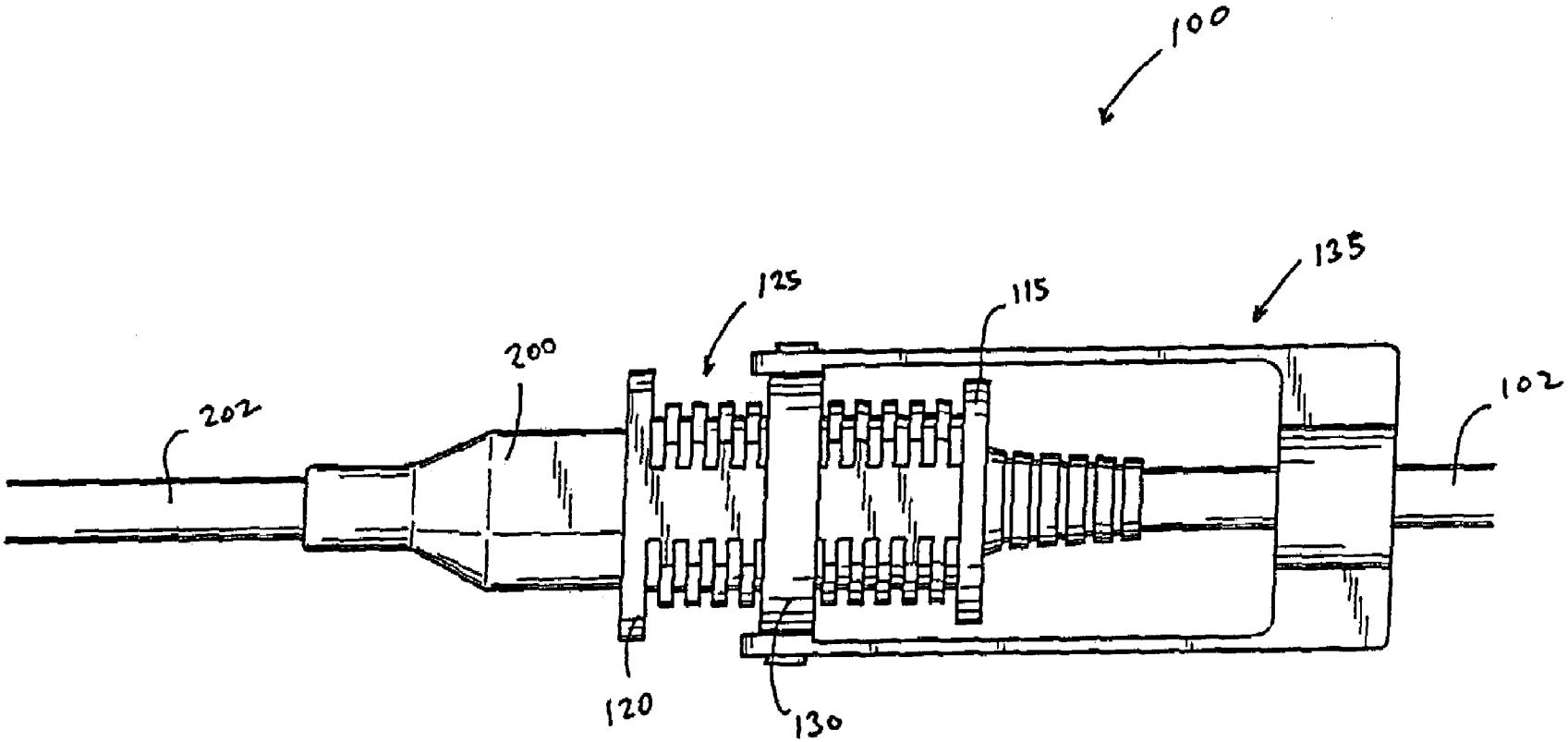
FIG. 7 illustrates another embodiment of securing the plug retention apparatus to a cord member.

As further illustrated in FIGS. 2–3, the retention ring 130 may be rotatably positioned about the threaded member 125 as illustrated by arrow 305. In one aspect, as illustrated in FIGS. 5–6, rotation of the retention ring 130 engages the threads of the threaded member 125 in such a manner so as to result in axial movement 310 along the shaft of the threaded member 125 of the plug retention apparatus 100. Advantageously, this allows ring member 130, including the plug clamp 135, to move axially between the base portion 115 and the head portion 120 of the first plug member 105 so as to secure the second plug member 200 to the first plug member 105. In this position, the second plug member 200 is positioned adjacent the head portion 120 of the first plug member 105; In addition, the retention ring 130 is desirably positioned about the threaded member 125 in such a manner so that when the first plug member 105 is engaged with the second plug member 200 and the plug clamp 135 is positioned about the second plug member 200 the connection between the two plug members 105, 200 is secured. Moreover, as illustrated in FIG. 7, the clamp member 135 can be pivotally attached to the ring member 130 such that the clamp member 135 can be secured to the first cord member 102 when the plug retention apparatus 100 is not in use securing the first and second plug members 105, 200 together.

In one aspect, the secured position between the two plug members 105, 200 may be accomplished by rotating the plug clamp 135 into a position wherein its axial position is generally in-line with the first plug member 105. When so positioned the plug clamp 135 is retained in an axially fixed position by the retention ring 130. Thus, when so positioned the first and second plug members 105, 200 are desirably secured and resistant to separation. Moreover, the opening 155 in the cord guide 150 can be used to capture the electrical cord 202 extending from the second plug member 200 and the latching member 160 closed to thereby secure the electrical cord 202 extending therefrom.

FIG. 4 further illustrates a method of securing cord members including the first and second cords 102, 202. In one embodiment, the method comprises engaging the first plug member 105 to the second plug member 200. As previously described, the first plug member 105 is electrically coupled to the first cord member 102 and includes the plug clamp 135 that pivots about a pivot point 220 on the retention ring 130. The plug clamp 135 is secured to the retention ring 130 via the first and second pivot ends 140 in a manner such that each pivot end 140 includes through-going apertures that are adapted to receive the protruding grommets 145 of the retention ring 130. As illustrated in FIG. 4, when attached in this manner, the plug clamp 135 may be angularly pivoted 133 from the first plug member 105 to facilitate coupling with the second cord member 202. In addition, the retention ring 130 threadably couples to the threaded shaft portion 125 of the first plug member 105.

FIG. 5 illustrates the coupling of the plug clamp 135 to the second cord member 202. In one embodiment, as illustrated in FIG. 5, when the retention ring 130 is positioned adjacent to the head portion 120 of the first plug member 105, the cross member portion 152 of the plug clamp 135 is positioned a first distance 230 from a rear portion 232 of the second plug member 200. In this position, the retention ring 130 can be threaded along the shaft portion 125 of the first plug member 105 in a first direction 234 towards the base portion 115 of the first plug member 105 so as to close the gap of the first distance 230 therebetween.

FIG. 6 illustrates the positioning of the plug clamp 135 adjacent to the second cord member 202. In one embodiment, as illustrated in FIG. 6, when the retention ring 130 is threaded towards the base portion 115 of the first plug member 105, the cross member portion 152 of the plug clamp 135 is positioned adjacent to the rear portion 232 of the second plug member 200. In this position, the retention ring 130 is threadably tightened or cinched along the shaft portion 125 of the first plug member 105 in the first secure position and the second plug member 200 to the first plug member 105. This position further closes the gap of the first distance 230 therebetween so that the second plug member 202 cannot be removed from the first plug member 1 OS. Advantageously, the threaded connection between the retention ring 130 of the plug clamp 135 and the shaft portion 125 of the first plug member 105 allows the second plug member 202 to be secured to the first plug member 105 without interfering with the electrical conduction therebetween. Additionally, this method of securing a plurality of cord members together improves operational safety by reducing the risk of disengaging the plug members 105, 200 during use.

FIG. 7 illustrates the ability of the plug clamp 135 of the first plug member 10*s* to be secured to the first cord member 102 during times of non-use or non-operation. In addition, this position also allows the second plug member 200 to be removed or disengaged from the first plug member 105. It should be appreciated that the method as disclosed in FIGS. 4–6 can be reversed in order so as to pivot the plug clamp away from the second cord member 202 and towards the first plug member 105 so as to couple the plug clamp 135 to the first plug member 102. Advantageously, this position prevents the clamp member 135 from flailing about during non-use, transport, or for storage.

Figure 8:
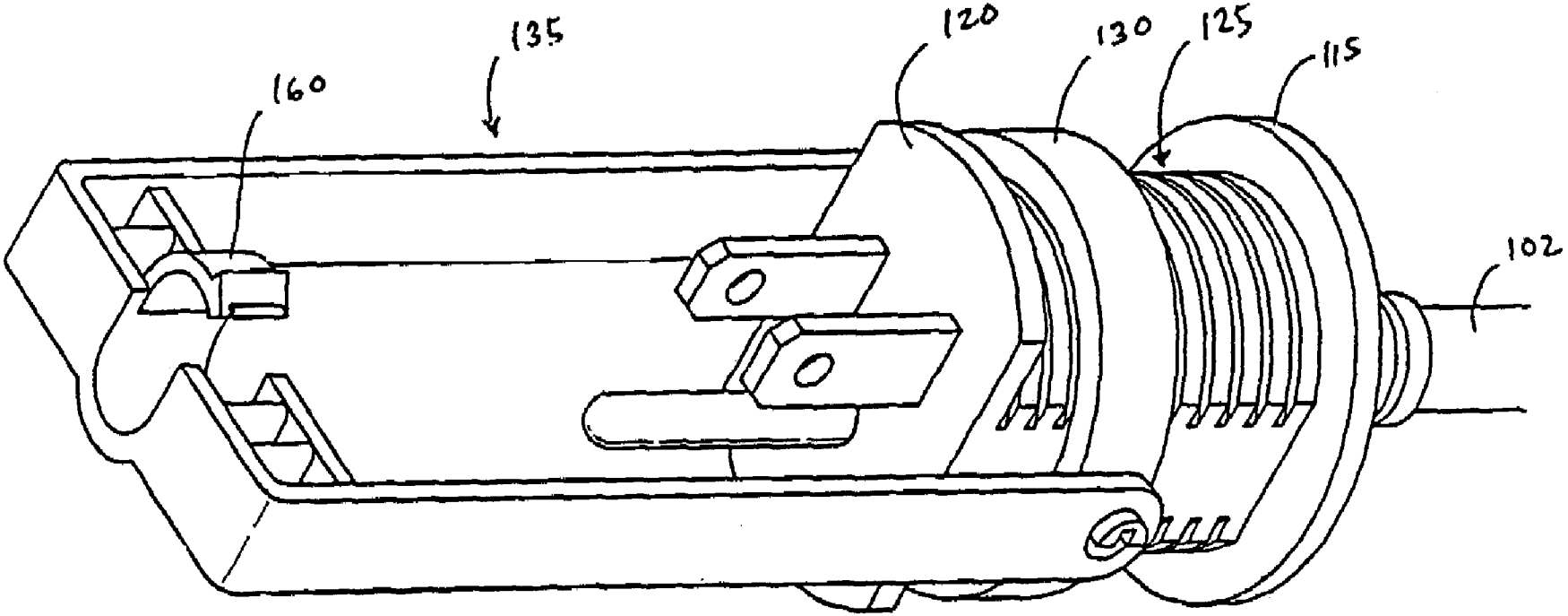
FIG. 8 illustrates another embodiment of the plug retention apparatus.

It should be appreciated by those skilled in the art that the plug retention apparatus 100 may be adapted to a male plug member 250 in manner as illustrated in FIG. 8. Also, the retention ring 130 may be adapted to be secured to and moved about the male plug member 250 in a similar manner as previously described with reference to the first plug member 105, which may comprise, for example, a female plug member. Therefore, the present teachings of the plug retention apparatus 100 as described herein should include various embodiments that are adaptable to male and female plug members.

Figure 9:
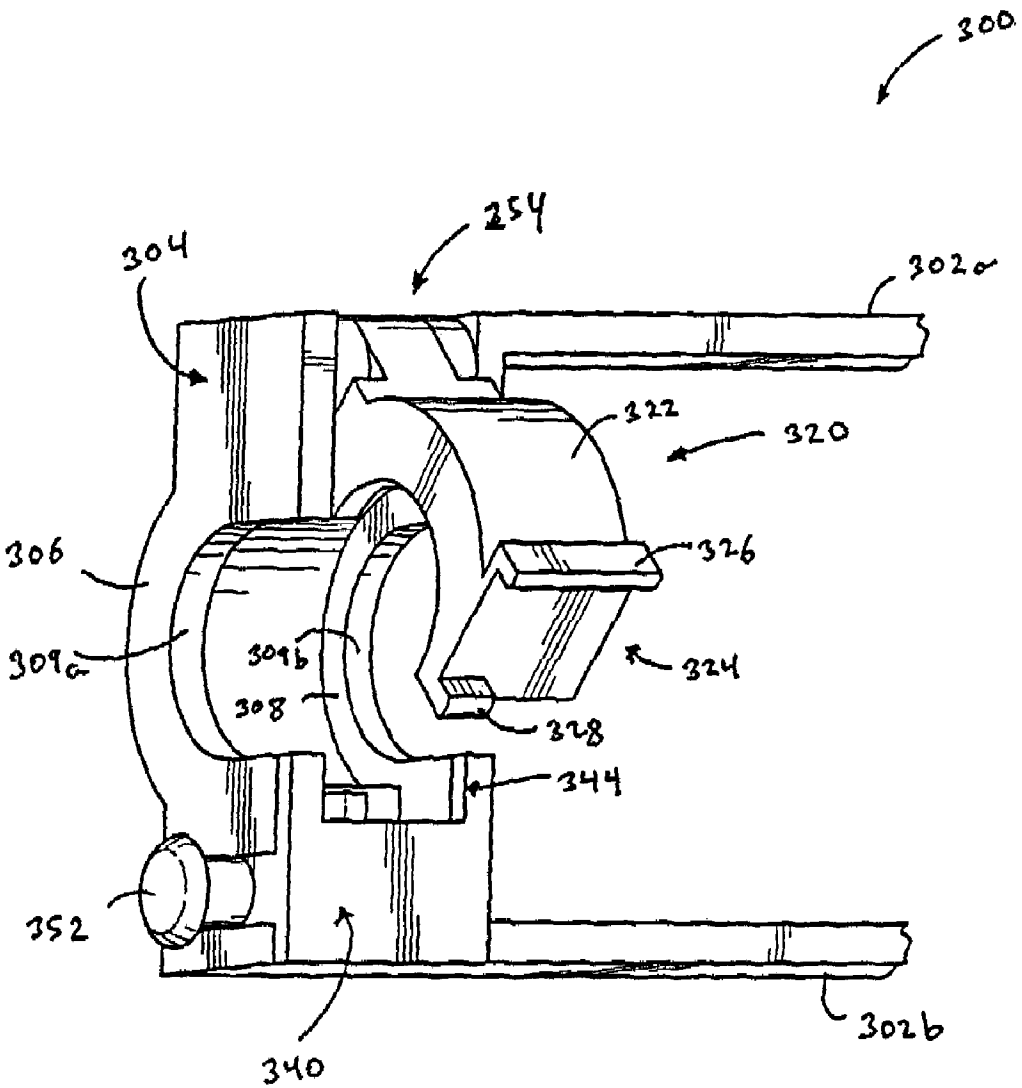
FIGS. 9–12 illustrate yet another embodiment of the plug retention apparatus.

FIG. 9 illustrates yet another embodiment of a plug clamp 300 for the plug retention apparatus 100. In the illustrated embodiment, the plug clamp 300 includes a first elongated member 302*a*, a second elongated member 302*b* generally parallel to the first elongated member 302*a*, and a cross member 304 disposed between the elongated members 302*a*, 302*b*. The cross member 304 includes a front member 306 and a rear member 308, having cord guide surfaces 309*a*, 309*b*, respectively, for supporting an electrical cord thereon.

Figure 10:
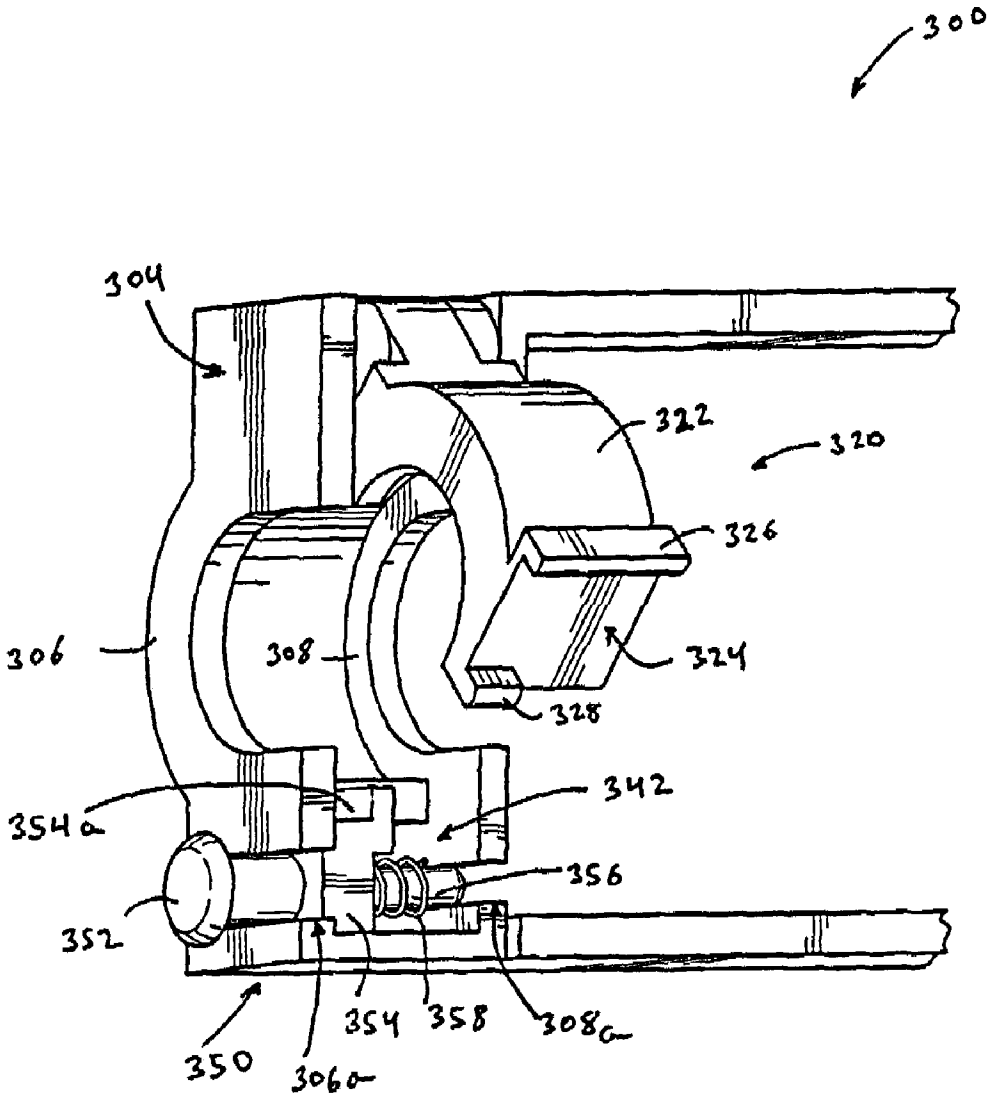

A securing member or latch 320 is movably connected to the cross member 304 and includes an arm 322 and a latching member 324. Preferably, the latch 320 is moveable between an open position (see FIG. 9) and a closed position (see FIG. 11). Additionally, the latch 320 has an inner surface 320*a*, which together with the cord guide surfaces 309*a*, 309*b* defines a cord passage 330 when the latch 320 is in the closed position. As shown in FIGS. 9 and 10, the latching member 324 includes a flange 326 and a tab 328. In the illustrated embodiment, the latch 320 is connected to the cross member 304 via the hinge 254 However, one of ordinary skill in the art will recognize that other mechanisms can be used to operatively connect the latch 320 to the cross member 304.

As shown in FIGS. 9 and 10, the cross member 304 also includes a body 340 with an inner compartment 342 defined between the front and rear members 306, 308. Preferably, the front and rear members 306, 308 are spaced apart by a distance sufficient to receive the latching member 324 therebetween and allow the flange 326 to align with an opening 344 on the body 340. In one preferred embodiment, the flange 326 is generally flush with the opening 344 when the latch 320 is in the closed position.

In the illustrated embodiment, the compartment 342 houses a locking mechanism 350 therein. The locking mechanism 350 includes an actuator button 352, a locking member 354 with an angled surface 354*a*, a post 356, and a spring 358 (See FIG. 10–12). As shown in FIG. 10, the button 352 slidably extends through an opening 306*a* in the front member 306. Similarly, the post 356 slidably extends through an opening 308*a* in the rear member 308. In the illustrated embodiment, the openings 306*a*, 308*a* are aligned with each other so that the button 352 and post 356 extend along an axis. The locking member 354 is preferably slidably movable along the axis and is biased against the front member 306 by the spring 358, which is disposed between the locking member 354 and the rear member 308 and exerts a force on the locking member 354.

The locking mechanism 350 can preferably be actuated to slidably move the locking member 354 from a first position adjacent the front member 306 to a second position away from the front member 306. In one embodiment, the button 352 and post 356 are attached separately to the locking member 354. In another embodiment, the button 352 and post 356 are integral and are coupled to an opening (not shown) in the locking member 354 via, for example, a press-fit connection. As described further below, the locking mechanism 350 (See FIGS. 10–12) preferably secures the latching member 324, and therefore the latch 320, to the body 340. Additionally, when the latch 320 is in the closed position, the locking mechanism 350 advantageously inhibits the disengagement of the latch 320 and the withdrawal of a cord disposed in the cord passage 330 due to a force exerted on the latch 320. Such a force can occur, for example, when a user rotates the retention ring 130 (FIG. 1) on the threads 125 to tighten the first and second plug members 105, 200 together.

Figure 11:
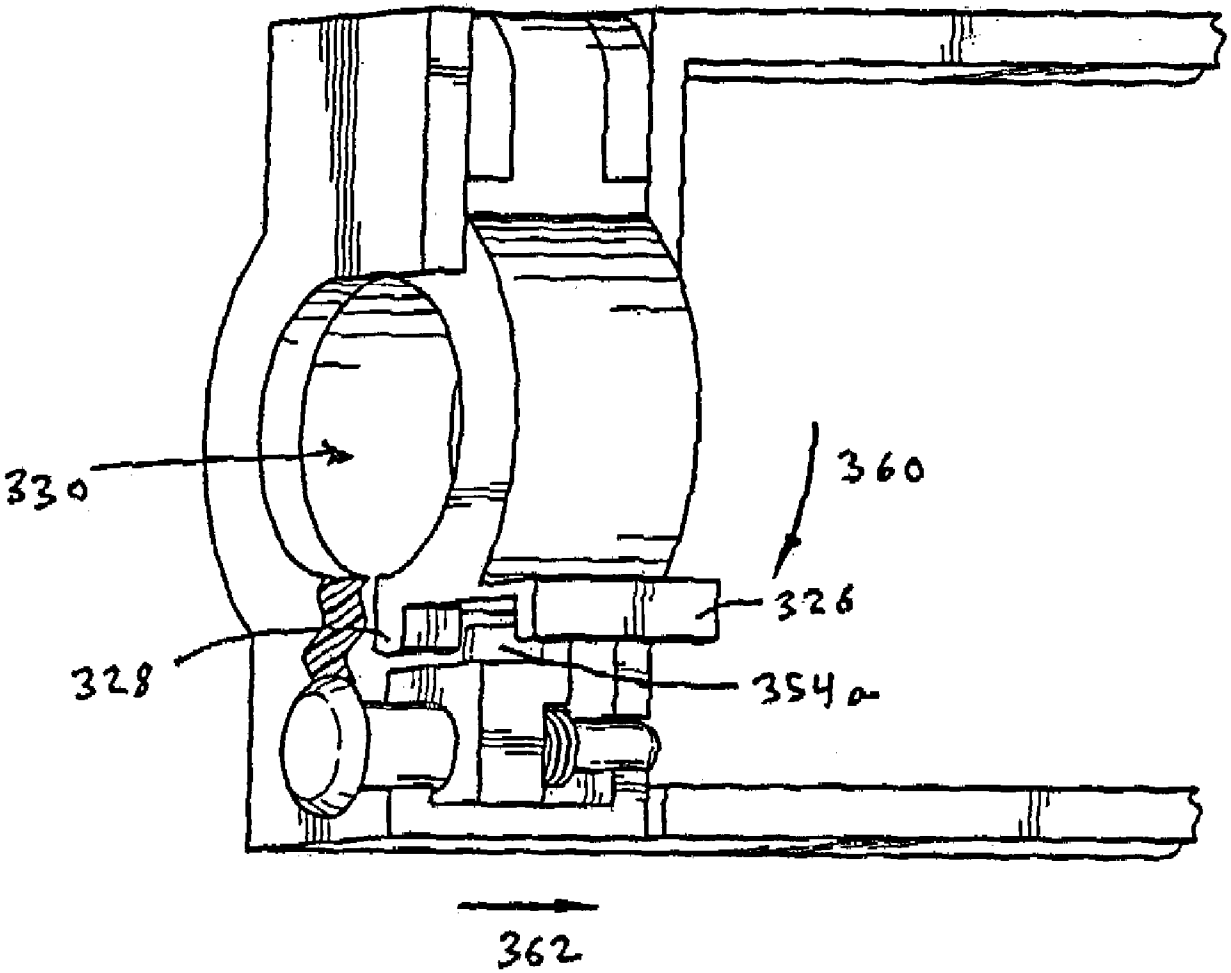
Figure 12:
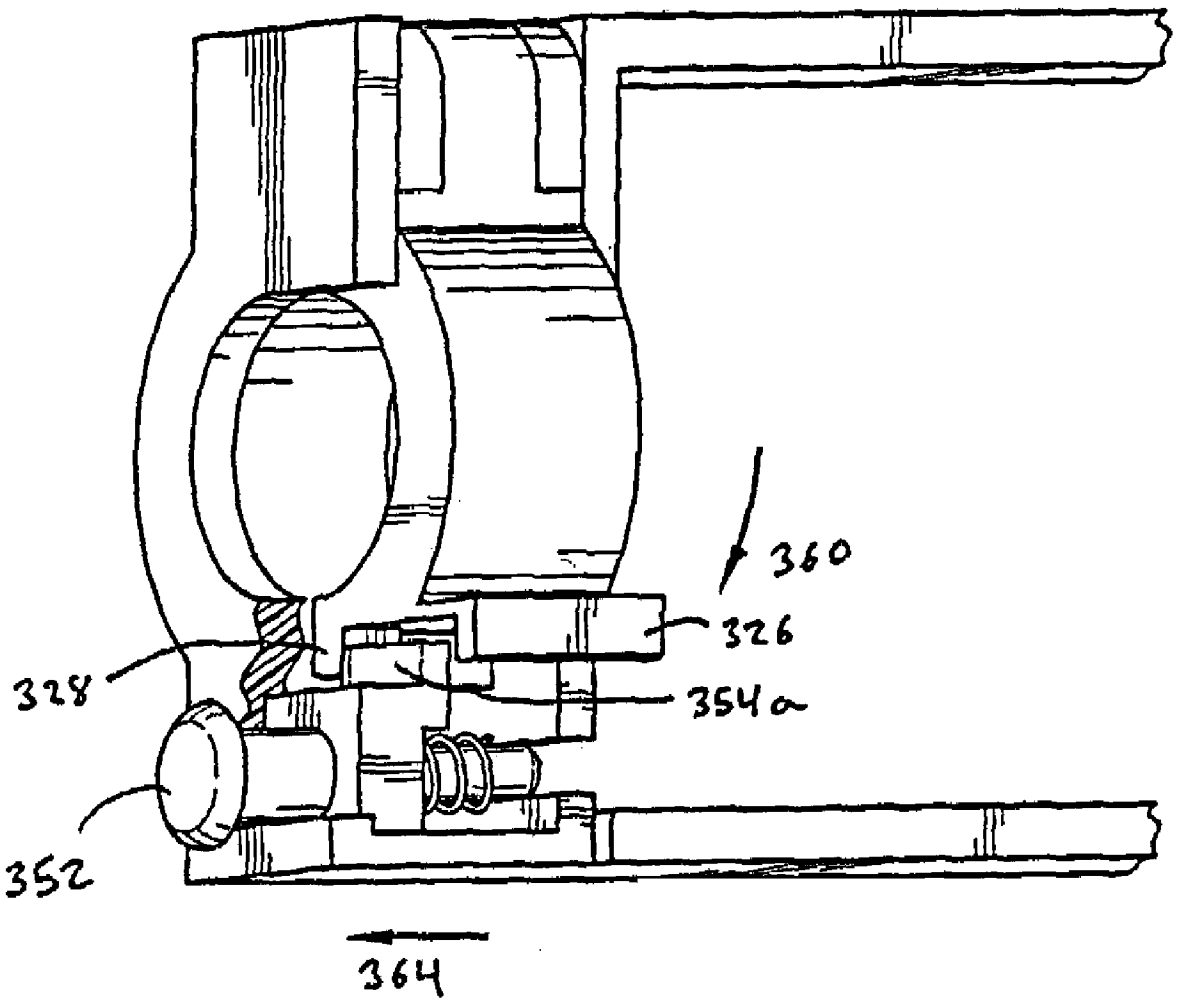

FIGS. 10–12 illustrate the operation of the locking mechanism 350. As shown in FIG. 10, the latch 320 is in the open position and the locking mechanism 350 is in a rest position, with the locking member 354 biased by the spring 358 against the front member 306 of the cross member 304. As the latch 320 is rotated downward 360 into the closed position, the tab 328 slides over the angled surface 354*a* and exerts a downward force thereon. Said downward force preferably overcomes the biasing force from the spring 358 and moves the locking member 354 in a forward direction 362 (See FIG. 11). Once the tab 328 clears the bottom of the angled surface 354*a*, the biasing force from the spring 358 moves the locking member 354 in the opposite direction 364 and back against the front member 306, placing the latch 320 in a locked position (See FIG. 12). In said locked position, the angled surface 354*a* is disposed between the tab 328 and the flange 326, inhibiting the removal of a cord disposed between the cord guide surfaces 309*a*, 309*b* and the latch 320. One of ordinary skill in the art will readily recognize that the locking mechanism 350 can be actuated by rotating the latch 320 in the downward direction 360 so that the tab 328 slides over the angled surface 354*a*, as described above, as well as through the actuation of the button 352, as discussed below.

In the illustrated embodiment, the locking mechanism 350 can be actuated to unlock the latch 320 by pressing the button 352 in the forward direction 362, which causes the locking member 354 to also move forward. Once the bottom of the angled surface 354*a* clears the tab 328, the latch 320 could then be rotated outward to withdraw the latching member 324 from the compartment 342. A cord disposed in the cord passage 330 could then be withdrawn from between the cord guide surfaces 309*a*, 309*b* and the latch 320.

Figure 13:
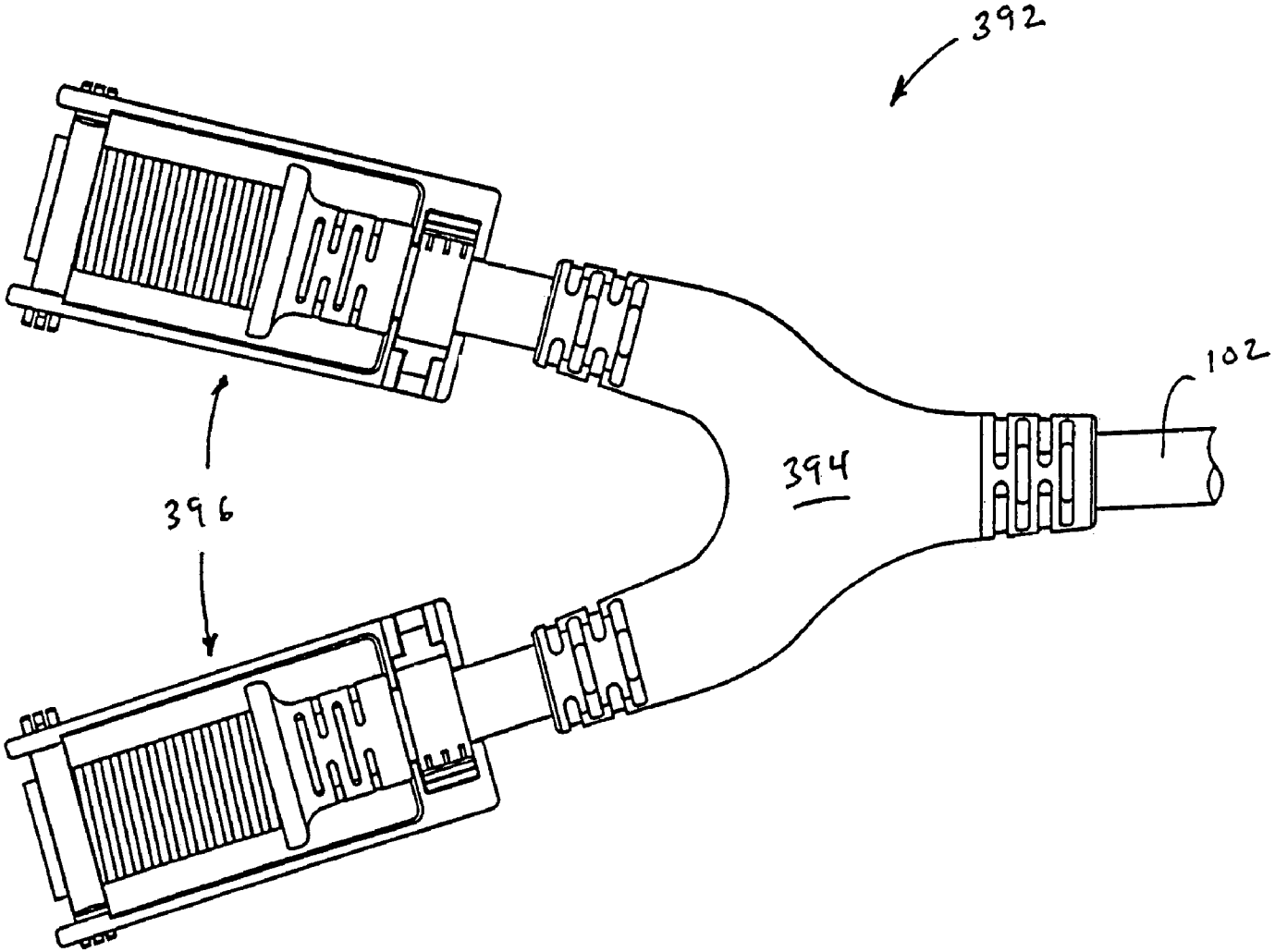
FIG. 13 illustrates yet another embodiment of the plug retention apparatus.

FIG. 13 illustrates yet another embodiment of a plug retention apparatus. In the illustrated embodiment, the plug retention apparatus is a dual plug retention apparatus 392. Preferably, the electrical cord 102 is attached to a Y adaptor 394, which enables two retention apparatuses 396 to be attached to the electrical cord 102. Preferably, the retention apparatuses 396 are configured in accordance with any of the embodiments disclosed herein. Although FIG. 13 only shows two plug retention apparatuses 396, one of ordinary skill in the art will recognize that more than two plug retention apparatuses could be attached to the electrical cord 102 without deterring from the spirit of this invention. This dual plug retention apparatuses 396 advantageously allow the user to utilize one electrical plug for multiple tools, as well as prevent all the tools from becoming disengaged from the electrical plug.

Figure 14:
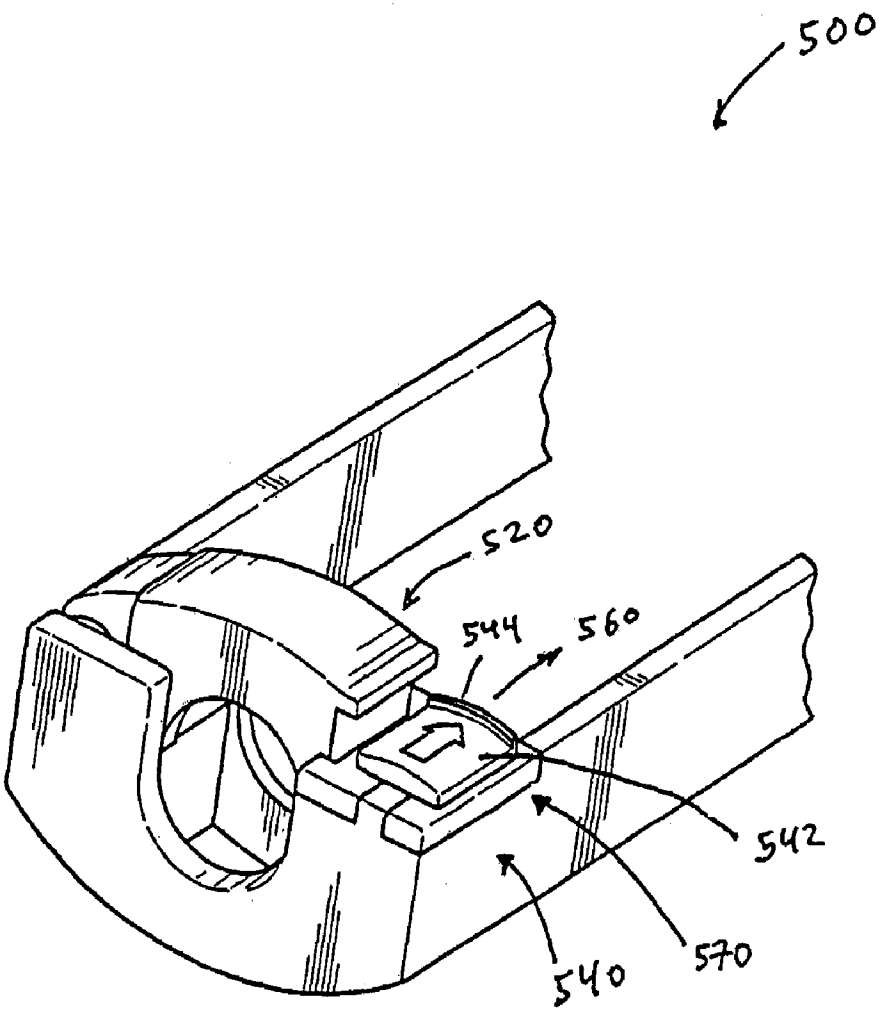
FIG. 14 is another embodiment of a securing member of the plug retention apparatus.

FIG. 14 illustrates yet another embodiment of a plug clamp 500. The plug clamp 500 includes a locking mechanism 540 for removably securing a latch 520 in a locked position. In the illustrated embodiment, the latch 520 can be rotated downward into locking engagement with the locking mechanism 540 in a manner similar to that described above with respect to FIGS. 9–12. The locking mechanism 540 includes a tab 542 actuatable to release the latch 520 from the locked position. As shown in FIG. 14, the tab 542 can be moved in a forward direction 560 to release the latch 520. Preferably, the tab 542 is biased, for example, via a spring, to return to a rest position 570 after actuation. In the illustrated embodiment, the tab 542 has a ridge 544 configured to facilitate the actuation of the tab 542, for example, by a user's finger.

Figure 15:
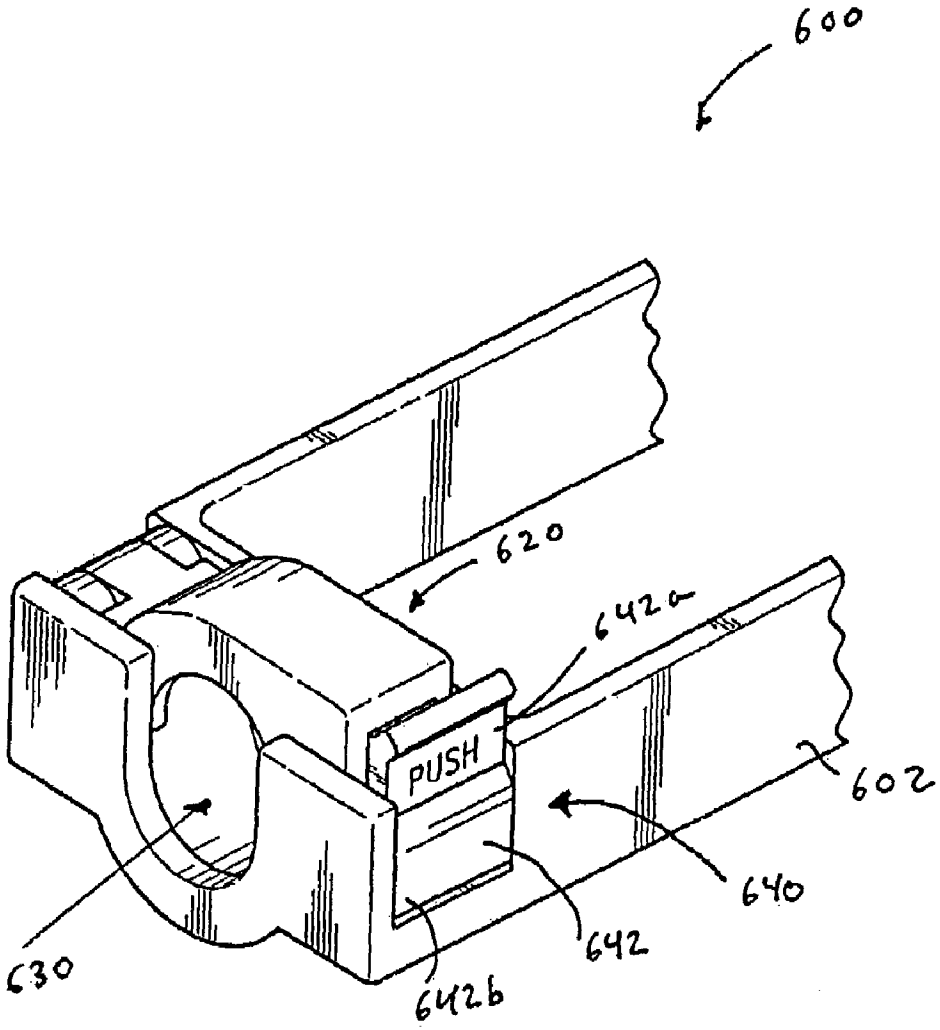
FIG. 15 is another embodiment of a securing member of the plug retention apparatus.

FIG. 15 illustrates yet another embodiment of a plug clamp 600. The plug clamp 600 includes a locking mechanism 640 for removably securing a latch 620 in a locked position. In the illustrated embodiment, the latch 620 can be rotated downward into locking engagement with the locking mechanism 640. The locking mechanism 640 includes a lever 642 pivotably connected to the latch 620 and having an upper portion 642*a* and a lower portion 642*b*. Preferably, the lever 642 is pivotable about an axis disposed between the upper and lower portions 642*a*, 642*b* and extending generally parallel to an elongated member 602 of the clamp 600. In the locked position, as shown in FIG. 15, the lower portion 642*b* of the lever 642 preferably lockingly engages a locking member (not shown) disposed, for example, on the elongated member 602. Accordingly, as the latch 620 is rotated downward, the lower portion 642*b* of the lever 642 pivots outward over the locking member, then inward to engage said locking member. To release the latch 620, a user would press on the upper portion 642*a* of the lever, thus withdrawing the lower portion 642*b* of the lever 642 from engagement with the locking member. The latch 620 could then be rotated upward to expose a cord (not shown) disposed in a cord passage 630. One of ordinary skill in the art will readily recognize that in another embodiment the lever 642 could alternatively be pivotably connected to the elongated member 602 and the locking member could be disposed on the latch 620. In said embodiment, as the latch 620 was rotated downward, the upper portion 642*a* of the lever 642 would pivot outward over the locking member and then inward to engage said locking member. To release the latch 620, a user would press the lower portion 642*b* of the lever, thus withdrawing the upper portion 642*a* of the lever 642 from engagement with the locking member.

From the foregoing, it will be appreciated that the plug retention apparatus 100, 300, 500, 600 provides a convenient way in which to secure plug components 120, 200 that are to be joined to one another preventing disengagement until desired. Advantageously, the adjustable aspect of the retention ring 130 provides a mechanism by which to secure a variety of different plug configurations desirably accommodating different plug and cord sizes. Moreover, the ability to angularly displace the plug clamp 135 away from the plug members 105, 202 allows the plug components 120, 200 to be rapidly engaged and disengaged as desired while still maintaining a securing force to the joined plug components when positioned axially in-line with the first plug member 105. Furthermore, the rotating ability of the retention ring 130 can be used to secure the plug members tightly by engaging the plug clamp 135 and then cinching down upon the joined plug members by rotating the retention ring 130 towards the base 115. When such an operation is performed, the plug members may be retained in a tightly secured configuration resilient to separation.

A wide variety of materials may be used to construct the plug retention apparatus 100, 300, 500, 600 and may include by way of example: plastic, nylon, metal, wood, or other materials. In addition, the various components of the plug retention apparatus 100, 300, 500, 600 may be constructed from different materials as desired. Additionally, the retention ring 130 may be adapted to be secured to and moved about the first or second plug member 105, 200 in a manner other than rotatable movement. For example, the retention ring 130 may be adapted with a latching means such that it can be moved up and down the first plug member 105 without rotation of the retention ring 130. In this configuration, the retention ring 130 may be secured to the first plug member by a series of movement-retarding latches as will be appreciated by one of skill in the art. In other embodiments, the plug retention apparatus 100, 300, 500, 600 may be desirably adapted to be formed on a male plug member wherein a female plug member 105 is captured by the plug clamp. Furthermore, the apparatus 100, 300, 500, 600 may be adapted with a variety of other different plug configurations/combinations as desired to securely join the plug members.

Figure 16:
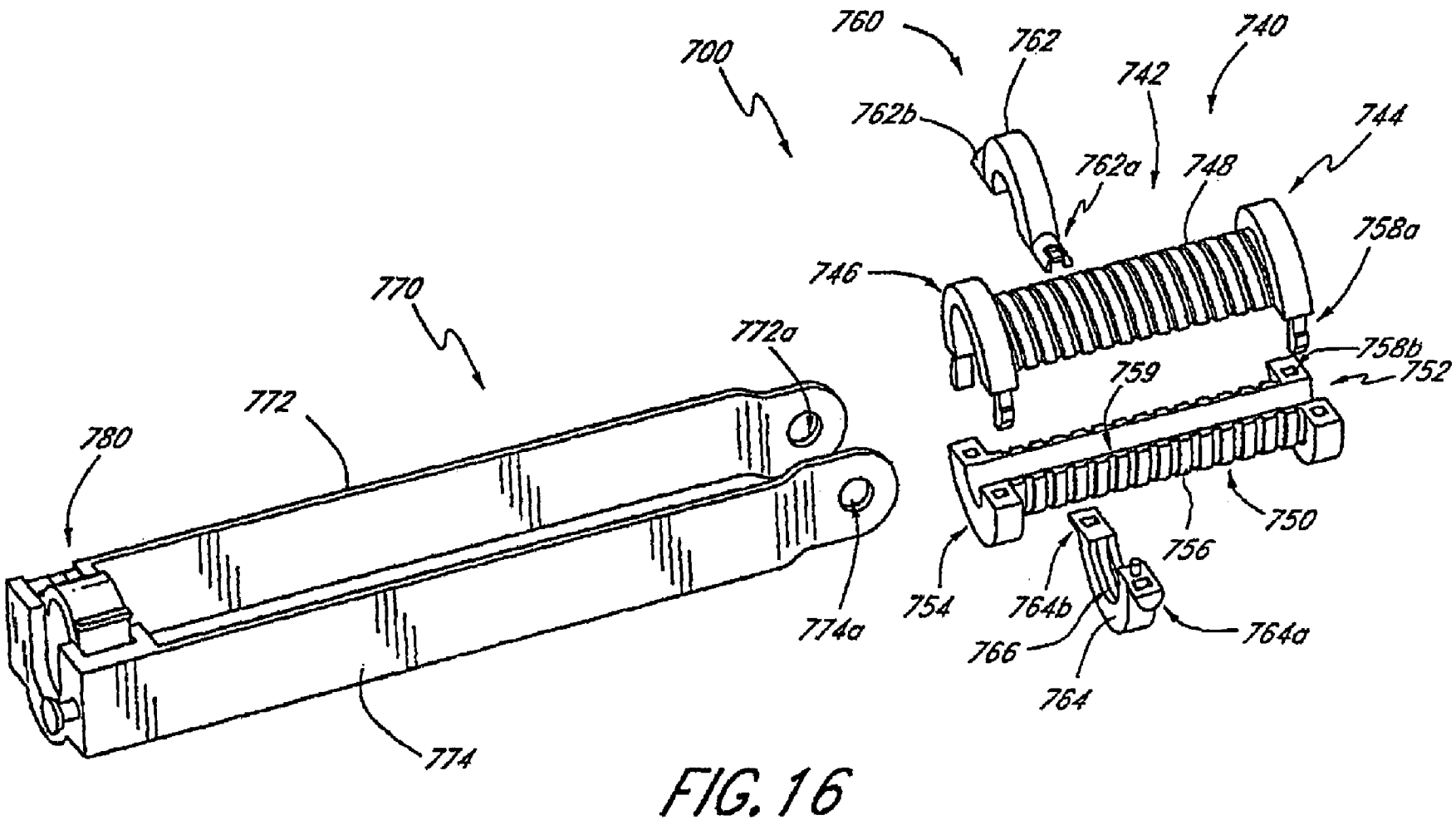
FIG. 16 is an exploded profile view of another embodiment of a plug retention apparatus.
Figure 18:
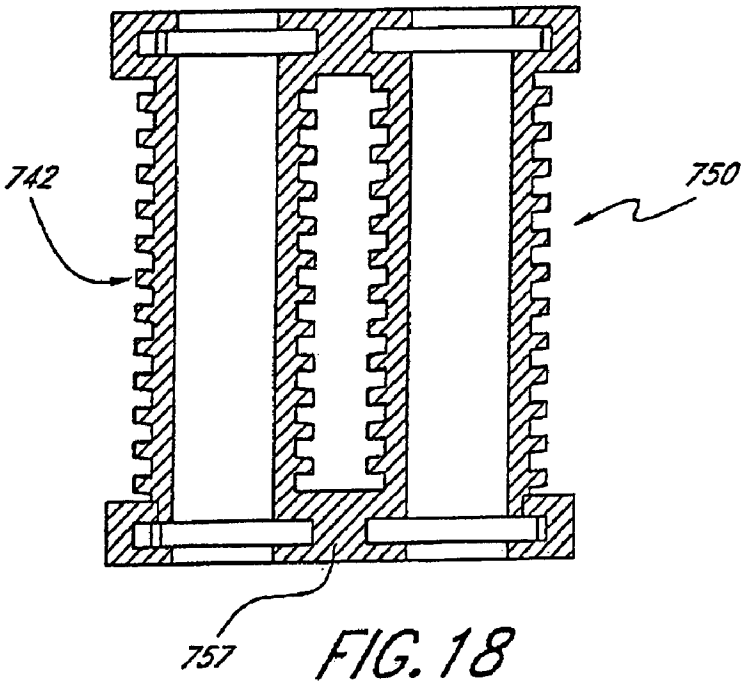
FIG. 18 is a bottom unassembled view of the sleeve of FIG. 17.
Figure 19:
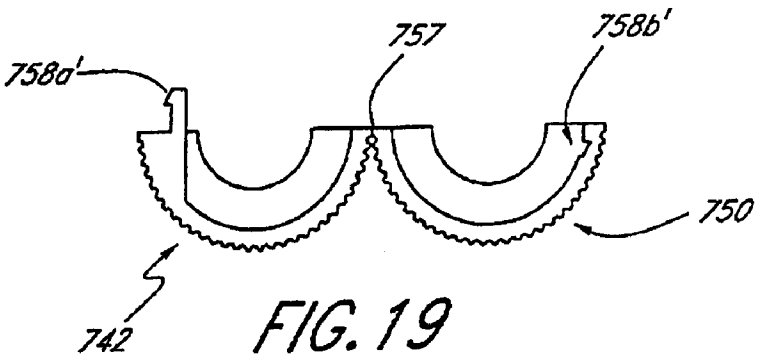
FIG. 19 is a cross-sectional side view of the sleeve of FIG. 17.
Figure 17:
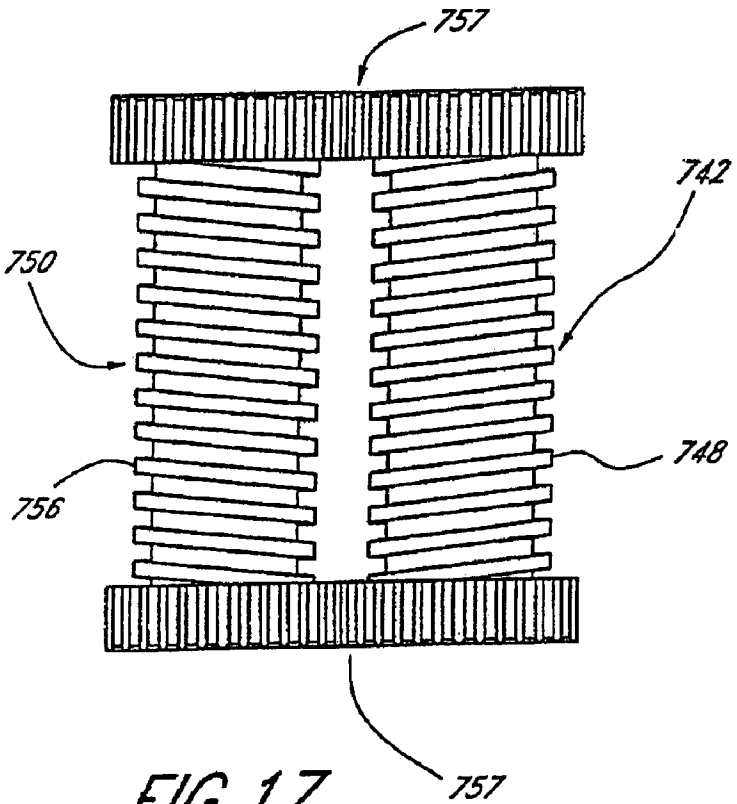
FIG. 17 is a top view of one embodiment of a sleeve, in an unassembled configuration, used with the plug retention apparatus of FIG. 16.

FIG. 16 illustrates another embodiment of a plug retention apparatus 700. The plug retention apparatus 70 includes a first member 740 having a first portion 742 extending from a first end 744 to a second end 746. In the illustrated embodiment, the first member 740 is a sleeve 740. The first portion 742 preferably has a generally curved body in the shape of a half-cylinder. However, the first portion 742 can have other suitable shapes. The body of the first portion 742 has threads 748 formed on an outer surface thereof. The sleeve 740 also has a second portion 750, which extends from a first end 752 to a second end 754 and has a body in the shape of a half-cylinder. However, the second portion 750 can have other suitable shapes. The body of the second portion 750 has threads 756 formed on an outer surface thereof. The sleeve 740 also preferably includes projections 758*a* on the first portion 742 that engage slots 758*b* on the second portion 750 to form the assembled sleeve 740. In one embodiment, the projections 758*a* removably engage the slots 758*b*. However, one of ordinary skill in the art will recognize that other mechanisms can be used to couple the first and second portions 742, 750 of the sleeve 740 together. In one embodiment, as shown in FIGS. 17–19, the first and second portions 742, 750 can be joined by a hinge 757 on one side of the portions 742, 750, and joined by a projection 758*a*' and a recess 758*b*' on an opposite side of the portions 742, 750. In one embodiment, the hinge 757 is a resilient living hinge. In another embodiment, the first and second portions 742, 750 can be coupled together via an adhesive.

Once assembled, the first and second portions 742, 750 of the sleeve 740 preferably define a generally cylindrical body with a channel 759 extending therethrough. In the assembled configuration, the threads 748 of the first portion 742 preferably match up and correspond to the threads 756 in the second portion 750 to provide a continuous thread from the first end 744, 752 to the second end 746, 754 of the sleeve 740. Advantageously, the sleeve 740 can be assembled about an electrical cord (not shown) having a first plug member adapted to couple to a second plug member, so that the cord extends through the channel 759 and the first plug member is disposed adjacent the second end 746, 754 of the sleeve 740. Advantageously, the sleeve 740 can be used with a variety of electrical cord and first plug member designs. However, one of ordinary skill in the art will recognize that the member 740 can be other suitable mechanisms for attaching to an electrical cord, such as a clip.

Figure 20:
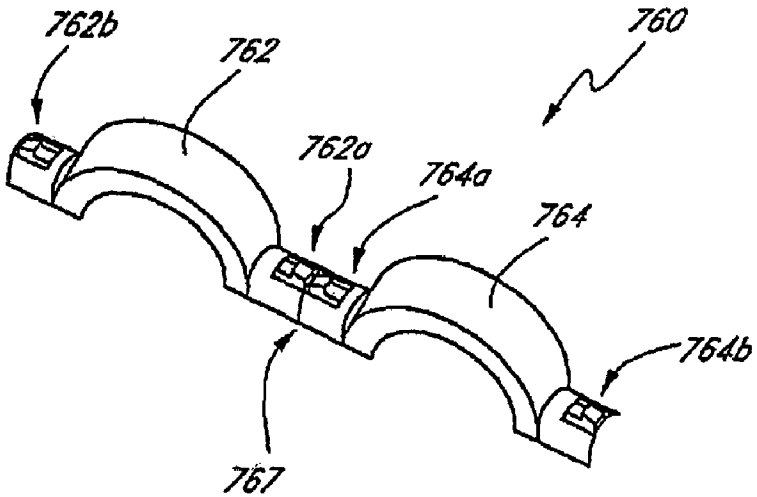
FIG. 20 is a profile view of one embodiment of a ring, in an unassembled configuration, used with the plug retention apparatus of FIG. 16.
Figure 21:
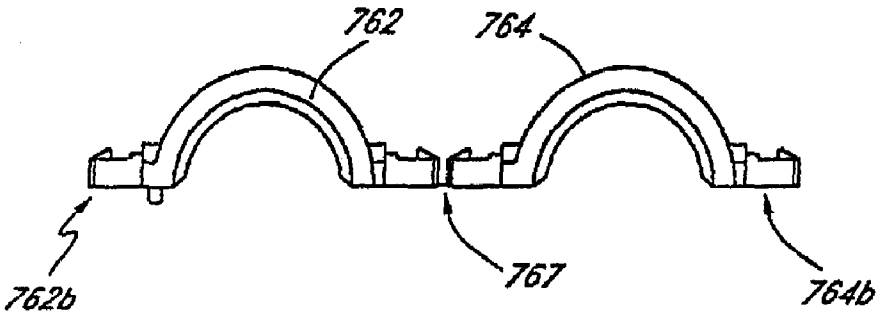
FIG. 21 is a side view of the ring of FIG. 20.
Figure 22:
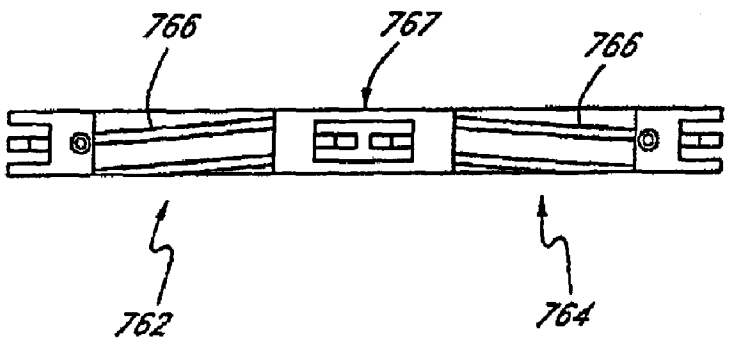
FIG. 22 is a bottom view of the ring of FIG. 20.

The plug retention apparatus 700 also includes a second member 760 having a first section 762 and a second section 764. In the illustrated embodiment, the second member 760 is a ring 760. The first section 762 preferably has a semi-circular shape and defines a pair of grommet halves 762*a*, 762*b* at its ends. Similarly, the second section 764 preferably has a semi-circular shape and defines a pair of grommet halves 764*a*, 764*b* at its ends. Additionally, the first and second sections 762, 764 have a thread 766 on an inner surface thereof. The first and second sections 762, 764 are preferably attached together to form the ring 760. In one embodiment, the first and second sections are removably coupled to each other so that the grommet halves 762*a*, 762*b* of the first section 762 join the grommet halves 764*a*, 764*b* of the second section 764. Any suitable mechanism can be used to couple the first and second sections 762, 764 together. In one embodiment, the first and second sections 762, 764 can be coupled via the interaction between a protrusion on one section 764 and a corresponding opening on the other section 762. In another embodiment, as shown in FIGS. 20–22, the first and second sections 762, 764 can be joined by a hinge 767 on one side of the sections 762, 764, and joined by the grommet halves 762*b*, 764*b* on an opposite side of the sections 762, 764. In one embodiment, the hinge 767 is a resilient living hinge. In other embodiments, the first and second sections 762, 764 can be coupled via other mechanism, such as adhesives and projection-slot connections, as discussed above. Preferably, when assembled together, the first and second sections 762,764 define continuous thread 766 therebetween. Additionally, when assembled about the sleeve 740, the thread 766 of the ring 760 can threadingly engage the threads 748, 756 of the sleeve 740, advantageously allowing the ring 760 to rotatingly translate along the length of the sleeve 740.

As shown in FIG. 16, the plug retention apparatus 700 also includes a plug clamp 770, having a first elongate member 772 and a second elongate member 774. In one preferred embodiment, the first and second elongate members 772, 774 extend generally parallel relative to each other. The first elongate member 772 has an opening 772*a* at a free end thereof. Similarly, the second elongate member 774 defines an opening 774*a* at a free end thereof. The openings 772*a*, 774*a* preferably align with each other. The openings 772*a*, 774*a* are sized to receive the assembled grommets defined by the grommet halves 762*a*, 764*a*, 762*b*, 764*b*. Accordingly, the ring 760 can be coupled to the plug clamp 770, with the sleeve 740 and the ring 760 being rotatingly movable relative to each other. Advantageously, the plug clamp 770 can pivot relative to the assembled sleeve 740 and ring 760 about an axis defined by the openings 772*a*, 774*a*.

Figure 23:
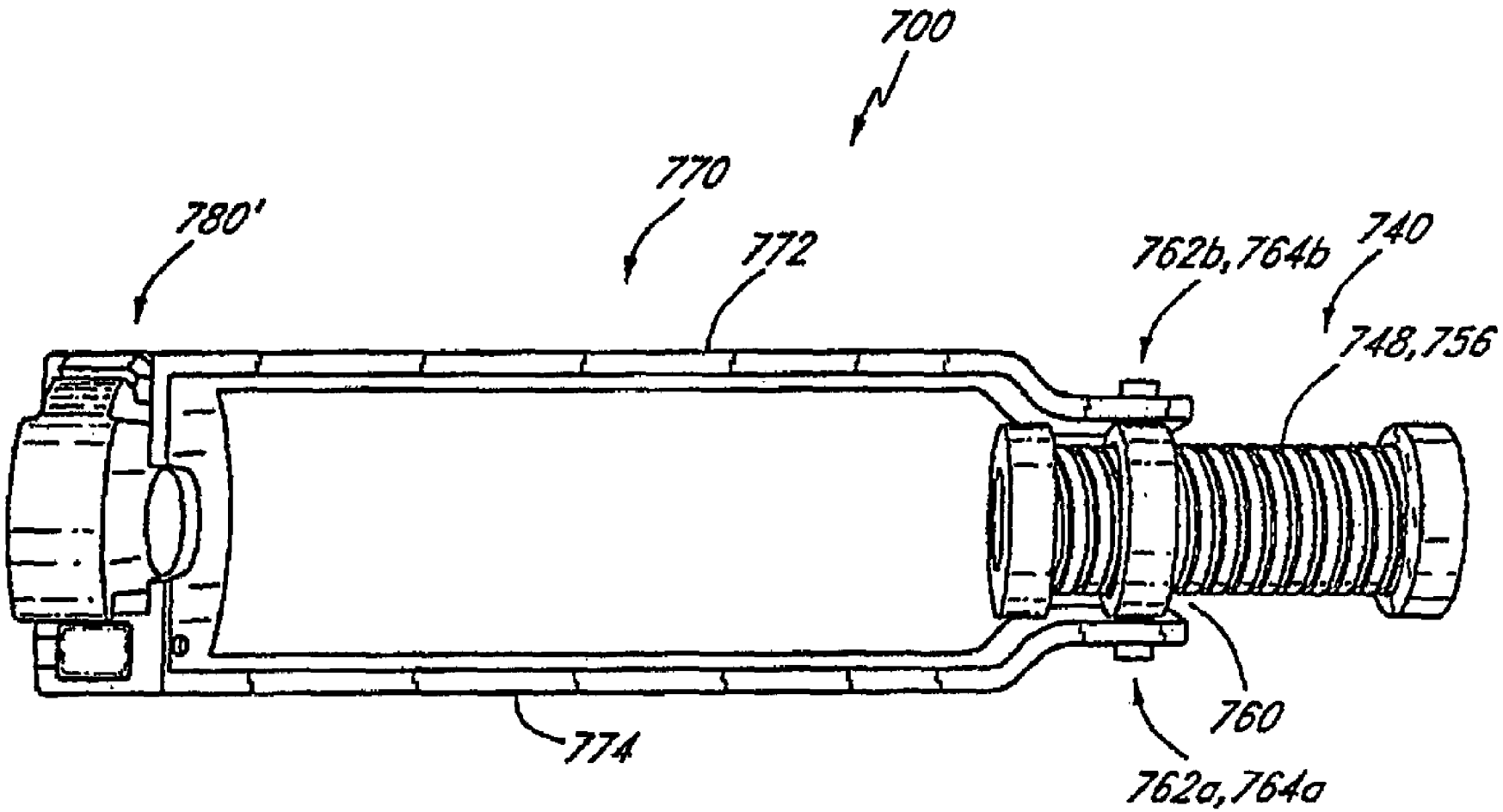
FIG. 23 is a top assembled view of another embodiment of a plug retention apparatus.

As shown in FIG. 16, the plug clamp 770 also preferably includes a securing member or latch 780 at an end of the first and second elongate members 772, 774 opposite the openings 772*a*, 774*a*. The securing member 780 can be configured according to any of the plug clamp embodiments discussed above. Moreover, the securing member 780 preferably includes a locking mechanism therein configured to inhibit the disengagement of the securing member 780 from a locked position, as described in any of the embodiments above. In the illustrated embodiment, the securing member 780 is disengaged by a button, such as the button 352 described above with regard to FIG. 10. In the illustrated embodiment, the securing member 780 is similar in design to that discussed above with respect to the plug clamp 300 illustrated in FIG. 10. In another embodiment shown in FIG. 23, which shows the plug retention apparatus 700 in an assembled configuration, the plug clamp 770 can have a securing member 780' similar in design to that discussed above with respect to the plug clamp 500 illustrated in FIG. 14. Additionally, the securing member 780' preferably includes a locking mechanism therein configured to inhibit the disengagement of the securing member 780' from a locked position, as described in any of the embodiments above. In the illustrated embodiment, the securing member 780' is disengaged by a tab, such as the tab 542 described above with regard to FIG. 14.

In use, as discussed above, the sleeve 740 and ring 760 can be assembled about a first electrical cord having a first plug member such that the first plug member is disposed adjacent the second end 746, 754 of the sleeve 740. The plug clamp 770 can then be coupled to the ring 760 via the grommets 762*a*, 764*a*, 762*b*, 764*b*. A second electrical cord having a second plug member can be fastened to the plug clamp 770 via the securing member 780, 780' so as to inhibit the disengagement of the securing member 780, 780' and the withdrawal of the second cord, and so that the second plug member is disposed adjacent the plug clamp 770 facing the first plug member. The first and second plug members can then be engaged, as described in the embodiments discussed above, an the sleeve 740 and ring 760 moved relative to each other to tighten the first and second plug members relative to each other.

Figure 24:
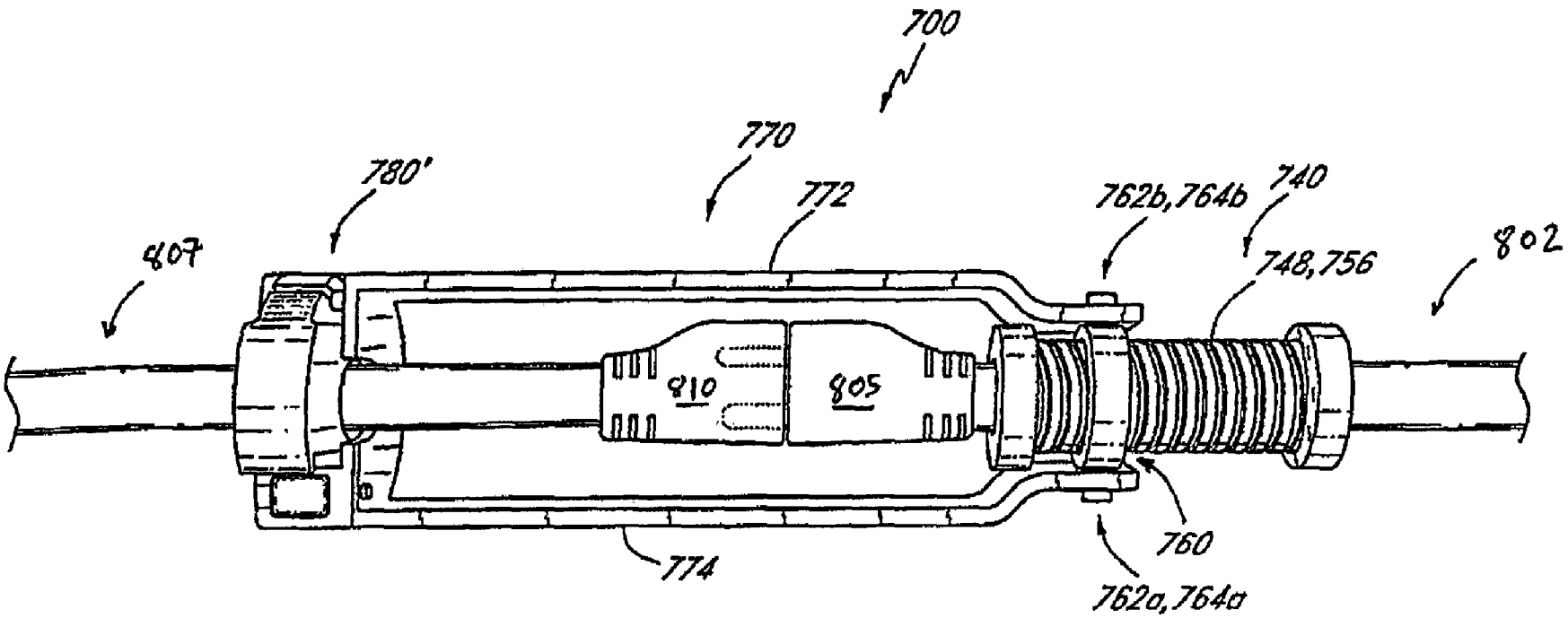
FIG. 24 is a top view of one operating position of the plug retention apparatus of FIG. 23 coupled to an existing first electrical cord electrically connected to a second electrical cord.
Figure 25:
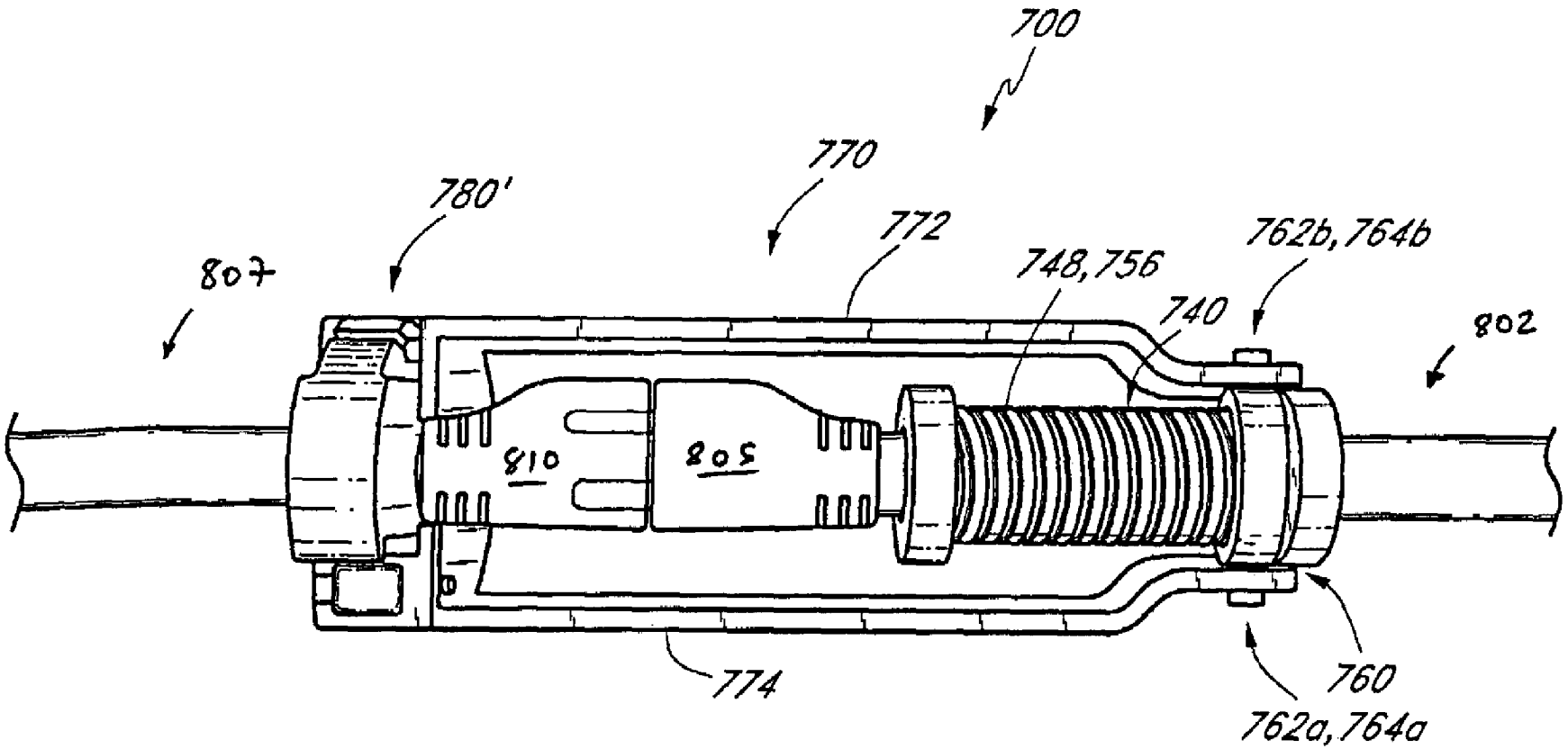
FIG. 25 is a top view of another operating position of the plug retention apparatus of FIG. 24.

As shown in FIG. 24, an existing electrical cord 802 having a plug member 805 can advantageously be retrofitted to include a plug retention apparatus, such as the plug retention apparatus 700 discussed above. The electrical cord 802 can be any existing electrical cord available, for example, in a home or business, or can be any electrical cord readily available at a hardware store. Accordingly, the plug retention apparatus 700 can advantageously be used with any existing electrical cord, and its use is not limited to a particular electrical cord or plug design. As noted above, the first and second portions 742, 750 can be assembled about the electrical cord 802 to form the sleeve 740 so that the plug member 805 is disposed proximal the second end 746, 754 of the sleeve 740. Likewise, the first and second sections 762, 764 can be assembled about the sleeve 740 to form the ring 760. The ring 760 can then be coupled to the first and second elongate members 772, 774 via the openings 772*a*, 774*a*. The plug member 805 can then be coupled to a second plug member 810 of a second electrical cord 807, wherein the second electrical cord 807 is coupled to the securing member 780' of the plug clamp 770, and wherein the plugs 805, 810 are disposed between the sleeve 740 and the securing member 780'. The plug retention apparatus 700 can be operated to inhibit the disengagement or disconnection of the plugs 805, 810. For example, the sleeve 740 and ring 760 can be rotated relative to each other so that the sleeve 740 translates toward the securing member 780', thus decreasing a distance between the sleeve 740 and the securing member 780'. Said decreased distance inhibits the disengagement of the plugs 805, 810, as shown in FIG. 25.

Of course, the foregoing description is that of certain features, aspects and advantages of the present invention, to which various changes and modifications can be made without departing from the spirit and scope of the present invention. Moreover, the plug retention apparatus need not feature all of the objects, advantages, features and aspects discussed above. Thus, for example, those skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed plug retention apparatus.

This application is a continuation-in-part of U.S. application Ser. No. 11/188,206 filed Jul. 21, 2005, which is a continuation-in-part of U.S. patent application Ser. No. 10/777,401 filed Feb. 12, 2004, now U.S. Pat. No. 6,957,977, which claims the benefit of U.S. Provisional Application 60/519,762, filed Nov. 13, 2003, which is hereby incorporated by reference in its entirety herein and should be considered a part of this specification. This application also claims priority to U.S. Provisional Application No. 60/661,053, filed Mar. 10, 2005, which is hereby incorporated by reference in its entirety and should be considered a part of this specification.

A plug retention apparatus for use in securing two plug members together to prevent undesired disengagement. The plug retention apparatus is affixed to a first plug member using a retention ring which provides a means for adjustable positioning via a threaded coupling to facilitate securing a second plug member to the first plug member. A plug clamp may be rotatably positioned about the second plug member retaining the plug members in a desired position. The plug retention apparatus may include a sleeve removably disposed about the cord of the first plug. The clamp used for retaining the second plug may include a cord support, a latch to secure the cord on the support and a locking mechanism to selectively retain the latch in a closed position.

What is claimed is:

1. An electrical cord retention apparatus for maintaining electrical connection between a first and a second electrical cord, comprising:

a sleeve removably disposed about the first electrical cord;

a retainer assembly that removably couples to the sleeve, the retainer assembly having a support surface that receives a second electrical cord; and a securing member movably attached to the retainer assembly wherein the securing member is movable between a first orientation thereby allowing the second electrical cord to be positioned adjacent the support surface and a second orientation wherein the securing member secures the second electrical cord adjacent the support surface, wherein the retainer assembly is axially displaceable relative to the sleeve while coupled to the first and second electrical cords to thereby reduce a distance between the sleeve and the securing member and inhibit the disconnection of the first and second electrical cords.

2. The apparatus of claim 1, further comprising a mechanism for inhibiting the withdrawal of the securing member from the second orientation, the mechanism including an actuator and a locking member configured to slidably move into engagement with the securing member when the securing member is moved into the second orientation.

3. The apparatus of claim 2, wherein the mechanism locks the securing member in the second orientation.

4. The apparatus of claim 1, wherein the securing member is a latch.

5. The apparatus of claim 2, wherein the actuator is a button.

6. The apparatus of claim 5, wherein the button is disposed so as to be actuatable by a force applied in a generally normal direction relative to a plane in which the securing member moves.

7. The apparatus of claim 2, wherein the actuator is a tab.

8. The apparatus of claim 7, wherein the tab is disposed so as to be actuatable by a force applied generally parallel and normal to a face of the tab.

9. The apparatus of claim 1, wherein the sleeve has first and second portions that are moveable into engagement with each other.

10. The apparatus of claim 9, wherein the first and second portions are attached via a hinge.

11. The apparatus of claim 1, further comprising a ring coupled to the retainer assembly and engaged to the sleeve, the ring and the sleeve being moveable relative to each other to inhibit the disconnection of the first and second electrical cords.

12. The apparatus of claim 11, wherein the ring has first and second sections that are moveable relative to each other.

13. The apparatus of claim 12, wherein first and second sections are attached via a hinge.

14. The apparatus of claim 11, wherein the sleeve has threads adapted to engage corresponding threads on the ring, the ring being rotatable so as to cause a corresponding translation of the sleeve in a direction generally perpendicular to the direction of rotation, the ring adapted to rotate so as to translate the sleeve toward the retainer assembly to inhibit the disconnection of the first and second electrical cords.

15. The apparatus of claim 1, wherein the retainer assembly is pivotable relative to the sleeve.

16. An electrical cord retention assembly for maintaining electrical connection between a first plug member of a first electrical cord and a second plug member of a second electrical cord, the first and second electrical cords being suitable for conducting electricity, comprising:

a first member removably disposed about the first electrical cord;

a second member coupled to the first member, the second member moveable relative to the first member;

a retainer assembly coupled to the second member and including a support surface that receives the second electrical cord;

a latch movably coupled to the retainer assembly, the latch being movable between an open position to allow the second electrical cord to be positioned on the support surface and a closed position wherein the latch secures the second electrical cord adjacent the support surface so that the second electrical cord can couple to the retainer assembly, and so that the first and second electrical cords couple to each other between the first member and the retainer assembly, wherein the retainer assembly and the first member are axially movable relative to each other while coupled to the first and second electrical cords so as to decrease a distance therebetween to inhibit the disconnection of the first and second electrical cords.

17. The assembly of claim 16, further comprising a mechanism for inhibiting the withdrawal of the latch from the closed position, the mechanism including an actuator coupled to a locking member, the locking member configured to slidably move into engagement with the tab when the latch is moved into the closed position.

18. The assembly of claim 17, wherein the mechanism locks the latch in the closed position.

19. The assembly of claim 17, wherein the actuator is a button.

20. The assembly of claim 19, wherein the button is disposed so as to be actuatable by a force applied in a generally normal direction relative to a plane in which the latch moves.

21. The assembly of claim 17, wherein the actuator is a tab.

22. The assembly of claim 21, wherein the tab is disposed so as to be actuatable by a force applied generally parallel and normal to a face of the tab.

23. The assembly of claim 16, wherein the first member has first and second portions moveable into engagement with each other.

24. The assembly of claim 23, wherein the first and second portions are attached via a hinge.

25. The assembly of claim 16, wherein the second member has first and second sections that are moveable relative to each other.

26. The assembly of claim 25, wherein the first and second sections are attached via a hinge.

27. The assembly of claim 16, wherein the first member has threads adapted to engage corresponding threads on the second member.

28. An electrical cord retention apparatus for maintaining an electrical connection between a first electrical cord and a second electrical cord, comprising:

a first member removably disposed about a first electrical cord so that the first member is adapted to allow the first electrical cord to be retrofitted with the retention apparatus;

a second member coupled to the first member, the first and second member adapted to move relative to each other; and a retainer assembly that removeably couples to the second member, the retainer assembly having a support surface that receives a second electrical cord so that the retainer assembly can be coupled to the second electrical cord, and so that the first and second electrical cords couple to each other between the first member and the retainer assembly, wherein the retainer assembly and the first member are axially moveable relative to each other while coupled to the first and second electrical cords to decrease a distance therebetween so as to inhibit the disconnection of the first and second electrical cords.

29. The apparatus of claim 28, wherein the first member is a sleeve.

30. The apparatus of claim 28, wherein the second member is a ring.

31. The apparatus of claim 28, wherein the first and second members are rotatingly coupled to each other.

32. The apparatus of claim 28, wherein the first member is positioned adjacent a first plug member of the first electrical cord.

33. The apparatus of claim 28, further comprising a securing member movably attached to the retainer assembly, wherein the securing member is movable between a first orientation thereby allowing the second electrical cord to be positioned adjacent the support surface and a second orientation wherein the securing member secures the second electrical cord adjacent the support surface.

* * * * *

UNITED STATES PATENT AND TRADEMARK OFFICE

CERTIFICATE OF CORRECTION

PATENT NO. : 7,182,624 B1
APPLICATION NO. : 11/226846
DATED : February 27, 2007
INVENTOR(S) : Thomas J. Miller It is certified that error appears in the above-identified patent and that said Letters Patent is hereby corrected as shown below:

In column 6 at line 14, Delete "105;" and insert -- 105, --, therefor.

In column 7 at line 11, Delete "1 OS." and insert -- 105 --, therefor.

In column 7 at line 22, Delete "10s" and insert -- 105 --, therefor.

In column 13 at line 38-62, below "retention apparatus," please delete:

"This application is a continuation-in-part of U.S. application Ser. No. 11/188,206 filed Jul. 21, 2005, which is a continuation-in-part of U.S. patent application Ser. No. 10/777,401 filed Feb. 12, 2004, now U.S. Pat. No. 6,957,977, which claims the benefit of U.S. Provisional Application 60/519,762, filed Nov. 13, 2003, which is hereby incorporated by reference in its entirety herein and should be considered a part of this specification. This application also claims priority to U.S. Provisional Application No. 60/661,053, filed Mar. 10, 2005, which is hereby incorporated by reference in its entirety and should be considered a part of this specification.

A plug retention apparatus for use in securing two plug members together to prevent undesired disengagement. The plug retention apparatus is affixed to a first plug member using a retention ring which provides a means for adjustable positioning via a threaded coupling to facilitate securing a second plug member to the first plug member. A plug clamp may be rotatably positioned about the second plug member retaining the plug members in a desired position. The plug retention apparatus may include a sleeve removably disposed about the cord of the first plug.

UNITED STATES PATENT AND TRADEMARK OFFICE

CERTIFICATE OF CORRECTION

PATENT NO. : 7,182,624 B1
APPLICATION NO. : 11/226846
DATED : February 27, 2007
INVENTOR(S) : Thomas J. Miller It is certified that error appears in the above-identified patent and that said Letters Patent is hereby corrected as shown below:

In column 13 at line 38-62...(cont'd):

The clamp used for retaining the second plug may include a cord support, a latch to secure the cord on the support and a locking mechanism to selectively retain the latch in a closed position."

Signed and Sealed this

Twenty-seventh Day of November, 2007

JON W. DUDAS
*Director of the United States Patent and Trademark Office*